US011286644B2

(12) United States Patent
Maekawa et al.

(10) Patent No.: US 11,286,644 B2
(45) Date of Patent: Mar. 29, 2022

(54) HYDRAULIC ACTUATOR FOR EXCAVATION WORK MACHINE

(71) Applicants: Kobe Steel, Ltd., Kobe (JP); KOBELCO CONSTRUCTION MACHINERY CO., LTD., Hiroshima (JP)

(72) Inventors: Satoshi Maekawa, Kobe (JP); Toshihiro Nogi, Kobe (JP); Sho Fujiwara, Hiroshima (JP)

(73) Assignees: Kobe Steel, Ltd., Kobe (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 17/268,308

(22) PCT Filed: Jul. 24, 2019

(86) PCT No.: PCT/JP2019/029045
§ 371 (c)(1),
(2) Date: Feb. 12, 2021

(87) PCT Pub. No.: WO2020/039834
PCT Pub. Date: Feb. 27, 2020

(65) Prior Publication Data

US 2021/0198868 A1 Jul. 1, 2021

(30) Foreign Application Priority Data

Aug. 23, 2018 (JP) ..... JP2018-156096

(51) Int. Cl.
*E02F 9/22* (2006.01)
*E02F 3/43* (2006.01)
(Continued)

(52) U.S. Cl.
CPC ..... *E02F 9/2228* (2013.01); *E02F 3/435* (2013.01); *E02F 9/2203* (2013.01);
(Continued)

(58) Field of Classification Search
CPC ..... E02F 3/437; E02F 9/2235; E02F 9/2282; E02F 9/2285; F15B 13/0403; F15B 2211/3058
See application file for complete search history.

(56) References Cited

U.S. PATENT DOCUMENTS 5,826,666 A * 10/1998 Tozawa ..... E02F 3/437 172/7
5,975,214 A 11/1999 Okamura et al.
(Continued)

FOREIGN PATENT DOCUMENTS

JP 5-321297 A 12/1993
JP 9-228404 A 9/1997
(Continued)

OTHER PUBLICATIONS

Extended European Search Report dated Sep. 10, 2021 in European Patent Application No. 19852377.1, 9 pages.
(Continued)

*Primary Examiner* — Abiy Teka
(74) *Attorney, Agent, or Firm* — Oblon, McClelland, Maier & Neustadt, L.L.P.

(57) ABSTRACT

A hydraulic drive apparatus includes a boom flow rate control valve, a target boom cylinder speed calculation part calculating a target boom cylinder speed for making a construction surface by a bucket closer to a target construction surface based on the cylinder speed of a boom cylinder and the like, and a boom flow rate operation part. The boom flow rate operation part operates the boom flow rate control valve to make a boom cylinder supply flow rate be a target
(Continued)

supply flow rate corresponding to the target boom cylinder speed when the target boom cylinder speed direction coincides with a cylinder thrust direction, and operates the boom flow rate control valve to make the boom cylinder discharge flow rate be a target discharge flow rate corresponding to the target boom cylinder speed when the target boom cylinder speed direction is opposite to the cylinder thrust direction.

4 Claims, 8 Drawing Sheets

(51) Int. Cl.
*E02F 9/26* (2006.01)
*F15B 15/02* (2006.01)
*E02F 3/32* (2006.01)

(52) U.S. Cl.
CPC ..... *E02F 9/2235* (2013.01); *E02F 9/2267* (2013.01); *E02F 9/2271* (2013.01); *E02F 9/2285* (2013.01); *E02F 9/2292* (2013.01); *E02F 9/2296* (2013.01); *E02F 9/262* (2013.01); *E02F 9/265* (2013.01); *F15B 15/02* (2013.01); *E02F 3/32* (2013.01)

(56) References Cited

U.S. PATENT DOCUMENTS

| | | | | |
|---|---|---|---|---|
| 6,108,948 | A * | 8/2000 | Tozawa | E02F 3/435 37/348 |
| 2009/0308068 | A1 | 12/2009 | Yoshino | |
| 2015/0039189 | A1* | 2/2015 | Wu | E02F 9/2075 701/50 |
| 2016/0251836 | A1* | 9/2016 | Baba | E02F 9/123 701/50 |
| 2016/0265187 | A1 | 9/2016 | Baba et al. | |
| 2017/0089033 | A1* | 3/2017 | Matsuyama | E02F 3/437 |
| 2017/0145662 | A1 | 5/2017 | Iwasaki et al. | |
| 2017/0183842 | A1* | 6/2017 | Yamashita | E02F 3/425 |
| 2018/0017887 | A1 | 1/2018 | Nakajima | |
| 2018/0087243 | A1 | 3/2018 | Ito et al. | |
| 2018/0172037 | A1 | 6/2018 | Cugati et al. | |
| 2019/0226181 | A1 | 7/2019 | Imura et al. | |

FOREIGN PATENT DOCUMENTS

| | | | |
|---|---|---|---|
| JP | 10-21 9727 | A | 8/1998 |
| JP | 2015-206415 | A | 11/2015 |
| JP | 2016-205495 | A | 12/2016 |
| JP | 2018-53675 | A | 4/2018 |
| WO | WO 2016/056678 | A1 | 4/2016 |
| WO | WO 2016/169939 | A1 | 10/2016 |
| WO | WO 2018/051511 | A1 | 3/2018 |

OTHER PUBLICATIONS

International Search Report dated Aug. 20, 2019 in PCT/JP2019/029045 filed on Jul. 24, 2019, 2 pages.

* cited by examiner

HYDRAULIC ACTUATOR FOR EXCAVATION WORK MACHINE

TECHNICAL FIELD

The present invention is related to an apparatus installed in an excavation work machine equipped with an excavation device including a boom, an arm and a bucket to hydraulically drive the excavation device.

BACKGROUND ART

A typical excavation work machine, such as a hydraulic excavator, includes an excavation device including a raiseable and lowerable boom, an arm rotatably coupled to the distal end thereof, and a bucket attached to the distal end of the arm. A typical apparatus for hydraulically driving such an excavation device includes a hydraulic pump, a plurality of hydraulic cylinders connected to the hydraulic pump, and control valves. The plurality of hydraulic cylinders include a boom cylinder for driving the boom, an arm cylinder for drive the arm and a bucket cylinder for driving the bucket. The control valves are connected to the boom cylinder, the arm cylinder and the bucket cylinder, respectively. Each of the control valves is formed of, for example, a pilot operated selector valve, which is opened so as to change the direction and the flow rate of the supply of hydraulic oil to the hydraulic actuator corresponding to the control valve, in response to a pilot pressure that is input to the control valve.

In recent years, furthermore, in order to reduce the burden on the operator, the development has been advanced on a hydraulic drive apparatus having an automatic control function of controlling the driving of the boom and the arm of the work device to allow an operator to move the bucket along a preset target locus only through a simple operation.

For example, Patent Document 1 discloses a hydraulic drive apparatus installed in a hydraulic excavator provided with a boom, an arm which is called a "stick" in Patent Document 1, and a bucket, and configured to calculate a target position and a target speed of each hydraulic cylinder to control the speed so as to make a cutting edge of the bucket be moved along a target locus in response to an operation applied to an arm operation lever, which is called "stick" in Patent Document 1.

In Patent Document 1, it is further described to calculate a compression force by multiplying a load pressure of a boom cylinder by a substantial pressure reception area in the cylinder and to automatically adjust the height position of the bucket so as to make the compression force closer to a preset target compression force, specifically, to reduce the compression force on the excavation surface by raising the bucket or to increase the compression force by lowering the bucket.

According to the apparatus described in Patent Document 1, however, it may be difficult to control the speed of the boom or the like with high accuracy depending on the direction or magnitude of the load acting on the boom or the like. Specifically, on the boom, there act both the downward load due to the self-weight of the entire work device including the boom and the upward load due to the reaction force received by the bucket from the construction surface, and the state of driving the boom cylinder drive may be greatly varied depending on the balance of the loads. Solving such a problem is significantly important because it directly results in accurate movement of the cutting edge of the bucket along the target locus and accurate control of pressing force applied from the bucket to the ground, which is called a compression force.

CITATION LIST

Patent Literature

Patent Literature 1: Japanese Unexamined Patent Publication No. 9-228404

SUMMARY OF INVENTION

It is an object of the present invention to provide a hydraulic drive apparatus installed in a work machine equipped with a work device including a boom, an arm and a bucket, the hydraulic drive apparatus being capable of controlling the movement of the boom with high accuracy in response to the movement of the arm so as to make a construction surface formed by the bucket closer to the target construction surface, regardless of load acting on the boom.

In order to increase the accuracy of the control, the present inventors have focused on the relationship between the direction of a target boom cylinder speed calculated for the operating speed of the boom cylinder, which is an actuator for moving the boom, and a cylinder thrust actually occurring in the boom cylinder. Specifically, in the case where the direction of the target boom cylinder speed coincides with the direction of the cylinder thrust, i.e., in the case of requiring the boom cylinder to be operated by the cylinder thrust in the direction of the cylinder thrust against the load acting on the boom, it is sufficient to control the flow rate of hydraulic oil to be pressed into the boom cylinder from the hydraulic pump similarly to a normal control; meanwhile, in the case where the direction of the target boom cylinder speed is, conversely, opposite to that of the cylinder thrust, i.e., in the case of requiring the boom cylinder to be operated in the direction of the load acting on the boom, which direction is opposite to the direction of the cylinder thrust, the pressure of hydraulic oil discharged from the boom cylinder serves as the holding pressure and, therefore, controlling the flow rate of the discharged hydraulic oil enables the control of the boom cylinder speed to be performed with high accuracy.

The present invention has been made from such a viewpoint. Provided is a hydraulic drive apparatus installed in a work machine equipped with a machine body and a work device attached to the machine body, the work device including a boom supported on the machine body so as to be raiseable and lowerable, an arm connected to a distal end of the boom so as to be rotationally movable, and a bucket attached to a distal end of the arm to be pressed against a construction surface, to hydraulically drive the boom, the arm, and the bucket, the hydraulic drive apparatus including: a hydraulic oil supply device including at least one hydraulic pump that is driven by a driving source to thereby discharge hydraulic oil; at least one boom cylinder that is expanded and contracted by supply of hydraulic oil from the hydraulic oil supply device to thereby raise and lower the boom; an arm cylinder that is expanded and contracted by supply of hydraulic oil from the hydraulic oil supply device to thereby rotationally move the arm; a bucket cylinder that is expanded and contracted by supply of hydraulic oil from the hydraulic oil supply device to thereby rotationally move the bucket; a boom flow rate control valve interposed between the hydraulic oil supply device and the at least one boom cylinder and being capable of performing opening and closing motions to change a boom cylinder supply flow rate which is a flow rate of hydraulic oil supplied from the hydraulic oil supply device to the at least one boom cylinder and a boom cylinder discharge flow rate which is a flow rate of hydraulic oil discharged from the boom cylinder; a target construction surface setting part that sets a target construction surface defining a target shape of an object to be constructed by the bucket; a working posture detection part that detects posture information which is information for determining a posture of the work device; a boom cylinder pressure detector that detects a head pressure and a rod pressure which are respective pressures of a head-side chamber and a rod-side chamber of the at least one boom cylinder; a cylinder speed calculation part that calculates cylinder speeds, which are respective operation speeds of the boom cylinder, the arm cylinder and the bucket cylinder, based on the posture information detected by the working posture detection part; a target boom cylinder speed calculation part that calculates a target boom cylinder speed which is a target value of an operation speed of the boom cylinder for making a surface to be constructed by the bucket along with movement of the arm caused by expansion and contraction of the arm cylinder closer to the target construction surface on the basis of the cylinder speeds calculated by the cylinder speed calculation part; and a boom flow rate operation part that operates the boom flow rate control valve to provide the target boom cylinder speed. The boom flow rate operation part is configured to operate the boom flow rate control valve to make the boom cylinder supply flow rate be a target supply flow rate corresponding to the target boom cylinder speed when a direction of the target boom cylinder speed calculated by the target boom cylinder speed calculation part coincides with a direction of a cylinder thrust which is a thrust of the boom cylinder determined by the head pressure and the rod pressure detected by the boom cylinder pressure detector, and configured to operate the boom flow rate control valve to make the boom cylinder discharge flow rate be a target discharge flow rate corresponding to the target boom cylinder speed when the direction of the target boom cylinder speed is opposite to the direction of the cylinder thrust.

DESCRIPTION OF EMBODIMENTS

There will be described preferred embodiments of the invention with reference to the drawings.

Figure 1:
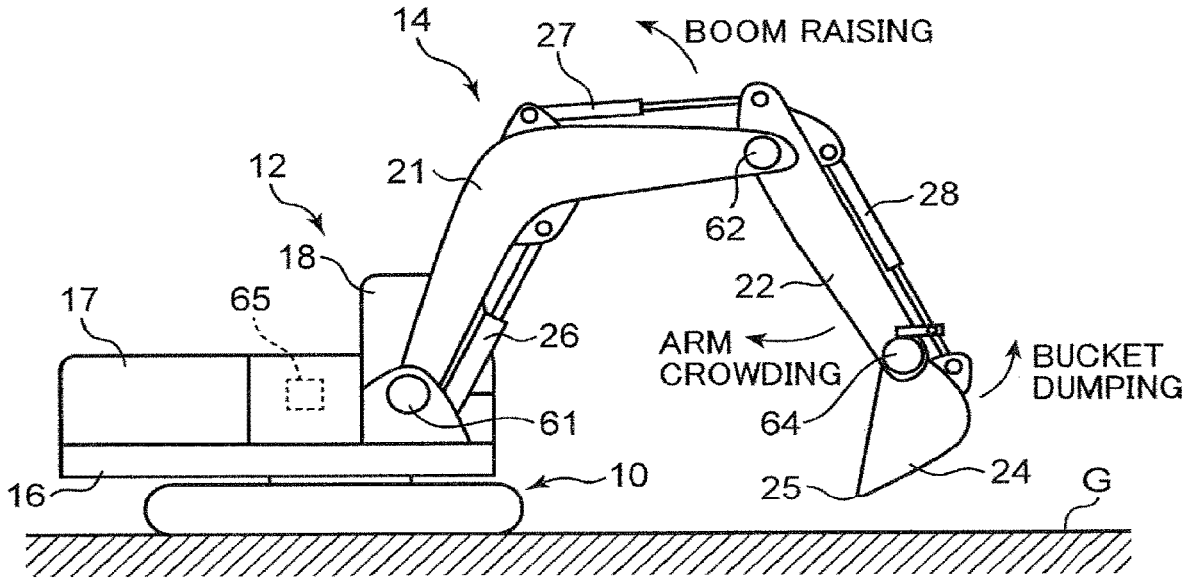
FIG. 1 is a side view showing a hydraulic excavator which is a hydraulic work machine according to an embodiment of the present invention.

FIG. 1 shows a hydraulic excavator according to the embodiment. The hydraulic shovel includes a lower travelling body 10 capable of travelling on the ground G, an upper turning body 12 mounted on the lower travelling body 10, a work device 14 mounted on the upper turning body 12, and a hydraulic drive apparatus that hydraulically drives the work device 14.

The lower travelling body 10 and the upper turning body 12 constitute a machine body that supports the work device 14. The upper turning body 12 includes a turning frame 16 and a plurality of elements mounted thereon. The plurality of elements include an engine room 17 for accommodating an engine and a cab 18 which is an operation room.

The work device 14 is capable of performing actions for excavation work and other necessary work, including a boom 21, an arm 22, and a bucket 24. The boom 21 has a proximal end and a distal end opposite to the distal end. The proximal end is supported on the front end of the turning frame 16 so as to be raiseable and lowerable, that is, movable rotationally about a horizontal axis. The arm 22 has a proximal end, which is attached to the distal end of the boom 21 movably rotationally about a horizontal axis, and a distal end opposite to the proximal end. The bucket 24 is mounted on the distal end of the arm 22 so as to be rotationally movable.

The hydraulic drive apparatus includes a plurality of expandable and contractable hydraulic cylinders provided for the boom 21, the arm 22 and the bucket 24, respectively: namely, at least one boom cylinder 26, an arm cylinder 27 and a bucket cylinder 28.

The at least one boom cylinder 26 is interposed between the upper turning body 12 and the boom 21, and expanded and contracted so as to make the boom 21 perform raised and lowered motions. The boom cylinder 26 has a head-side chamber **26*h* and a rod-side chamber 26*r* shown in FIG. 2. The boom cylinder 26 is expanded by supply of hydraulic oil to the head-side chamber 26*h* to actuate the boom 21 in a boom raising direction while discharging hydraulic oil from the rod-side chamber 26*r*. The boom cylinder 26 is, conversely, contracted by supply of hydraulic oil to the rod-side chamber 26*r* to actuate the boom 21 in a boom lowering direction while discharging hydraulic oil from the head-side chamber 26*h***.

The at least one boom cylinder 26 may be a single, but, in this embodiment, includes a pair of boom cylinders 26 arranged laterally in parallel to each other. For convenience, FIGS. 5 to 8 show the pair of boom cylinders 26 so that they are aligned longitudinally, that is, laterally on the paper surface.

The arm cylinder 27 is an arm actuator interposed between the boom 21 and the arm 22 and configured to be expanded and contracted to make the arm 22 perform a rotational motion. Specifically, the arm cylinder 27 has a head-side chamber **27*h* and a rod-side chamber 27*r* shown in FIG. 2. The arm cylinder 27 is expanded by supply of hydraulic oil to the head-side chamber 27***h* to actuate the arm 22 in an arm crowding direction, in which the distal end of the arm 22 approach the boom 21, while discharging hydraulic oil from the rod-side chamber 27*r*. The arm cylinder 27 is, conversely, contracted by supply of hydraulic oil to the rod-side chamber 27*r* to actuate the arm 22 in an arm pushing direction, in which the distal end of the arm 22 goes away from the boom 21, while discharging hydraulic oil from the head-side chamber 27*h*.

The bucket cylinder 28 is interposed between the arm 22 and the bucket 24 and expanded and contracted so as to make the bucket 24 perform a rotational motion. Specifically, the bucket cylinder 28 is expanded to thereby actuate the bucket 24 rotationally in a crowding direction, in which the tip 25 of the bucket 24 approaches the arm 22, and contracted to thereby actuate the bucket 24 in a dumping direction, in which the tip 25 of the bucket 24 goes away from the arm 22.

Figure 2:
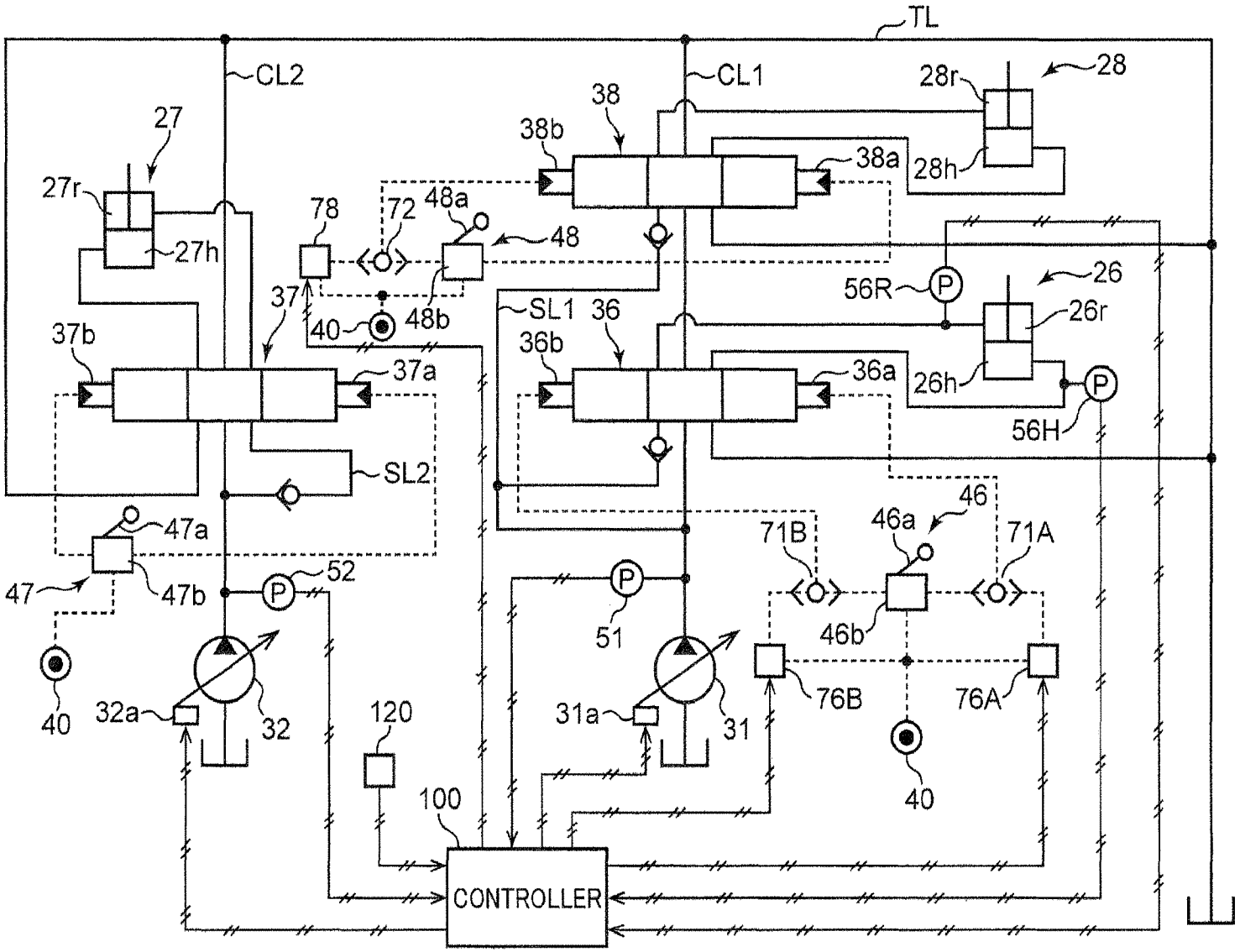
FIG. 2 is a diagram showing a hydraulic circuit and a controller that include components of a hydraulic drive apparatus installed on the hydraulic excavator.
Figure 3:
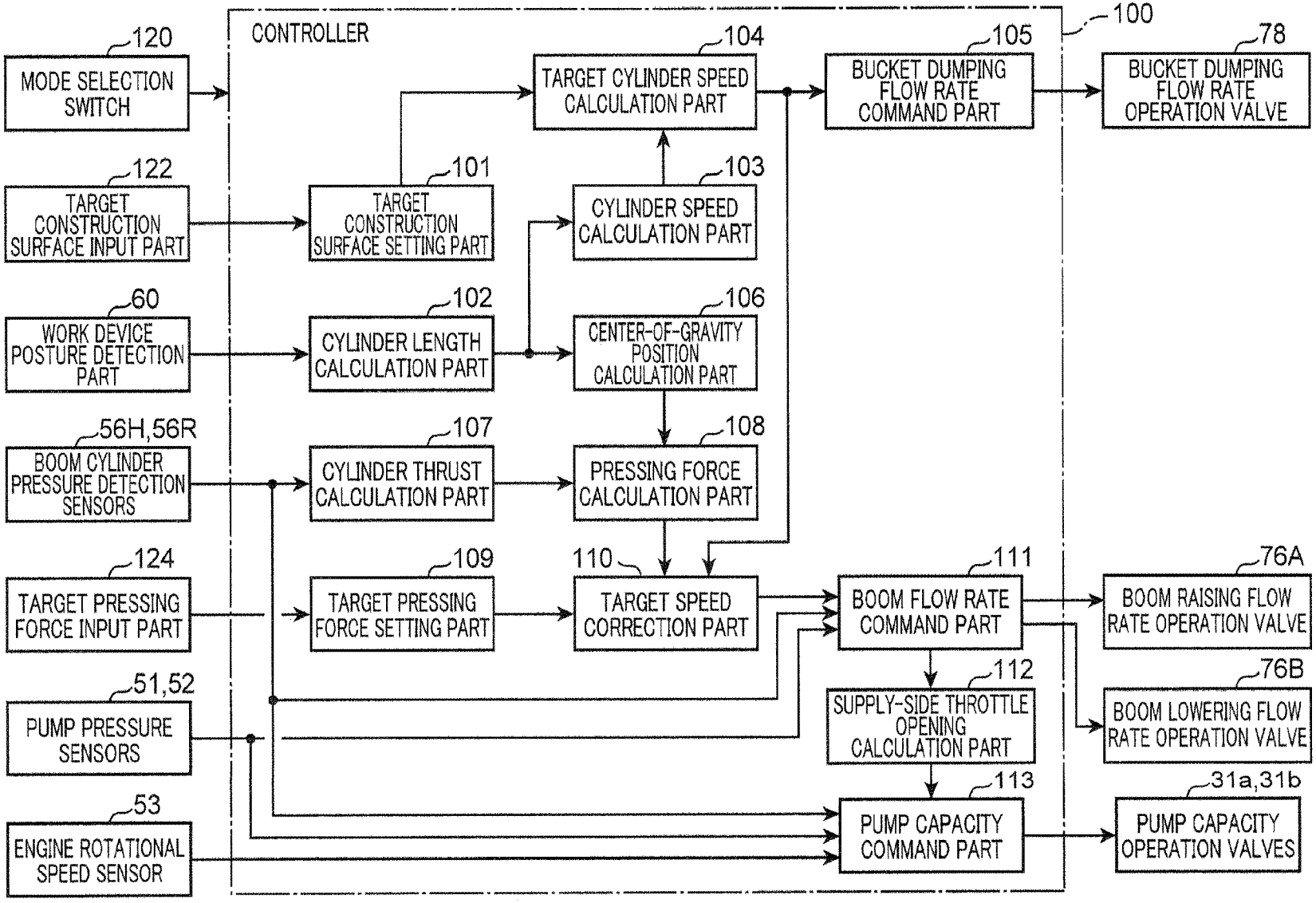
FIG. 3 is a block diagram showing the main functions of the controller included in the hydraulic drive apparatus.

FIG. 2 shows a hydraulic circuit installed in the hydraulic excavator and a controller 100 electrically connected thereto. The controller 100 is formed of, for example, a microcomputer, configured to control respective operations of the elements included in the hydraulic circuit.

The hydraulic circuit includes, in addition to the cylinders 26 to 28, a hydraulic oil supply device including a first hydraulic pump 31 and a second hydraulic pump 32, a boom flow rate control valve 36, an arm flow rate control valve 37, a bucket flow rate control valve 38, a pilot hydraulic pressure source 40, a boom operation device 46, an arm operation device 47, and a bucket operation device 48.

The first hydraulic pump 31 and the second hydraulic pump 32 are connected to a not-graphically-shown engine as a driving source, and driven by the power output by the engine to discharge hydraulic oil. Each of the first and second hydraulic pumps 31 and 32 is a variable displacement pump. Specifically, the first and second hydraulic pumps 31 and 32 have respective capacity operation valves 31*a* and 32*a*, and respective capacities of the first and second hydraulic pumps 31 and 32 are operated by respective pump capacity commands that are input from the controller 100 to the capacity operation valves 31*a* and 32*a*, respectively.

The boom flow rate control valve 36 is interposed between the first hydraulic pump 31 and the boom cylinder 26, and performs opening and closing motions to change a boom flow rate, which is the flow rate of hydraulic oil supplied from the first hydraulic pump 31 to the boom cylinder 26, and the flow rate of hydraulic oil discharged from the boom cylinder 26 to the tank. Specifically, the boom flow rate control valve 36 is formed of a pilot operated three-position direction selector valve having a boom raising pilot port 36*a* and a boom lowering pilot port 36*b*, being disposed in a first center bypass line CL1 that is connected to the first hydraulic pump 31.

The boom flow rate control valve 36 includes a not-graphically-shown casing and a spool inserted into the sleeve while allowed to stroke. The spool is held in a neutral position with no pilot pressure input to any of the boom raising and boom lowering pilot ports 36*a* and 36*b* to close the first center bypass line CL1 and block the communication between the first hydraulic pump 31 and the boom cylinder 26, thereby keeping the boom cylinder 26 stopped. The hydraulic oil discharged from the first hydraulic pump 31, meanwhile, is released to the tank through a not-graphically-shown unload valve.

By input of a boom raising pilot pressure to the boom raising pilot port 36*a*, the spool of the boom flow rate control valve 36 is shifted from the neutral position to a boom raising position by a stroke corresponding to the magnitude of the boom raising pilot pressure. This causes the boom flow rate control valve 36 to be opened so as to form an opening that allows hydraulic oil to be supplied from the first hydraulic pump 31 to the head-side chamber 26*h* of the boom cylinder 26 through a first supply line SL1 branched off from the first center bypass line CL1 at a flow rate corresponding to the stroke, namely, a boom raising flow rate, and so as to form an opening that allows hydraulic oil to return to the tank from the rod-side chamber 26*r* of the boom cylinder 26. The boom cylinder 26 is thereby driven in a boom raising direction, that is, in the expansion direction in this embodiment.

By input of a boom lowering pilot pressure to the boom lowering pilot port 36*b*, conversely, the boom flow rate control valve 36 is shifted from the neutral position to a boom lowering position by a stroke corresponding to the magnitude of the boom lowering pilot pressure, thus being opened so as to form an opening that allows hydraulic oil to be supplied from the first hydraulic pump 31 to the rod-side chamber 26*r* of the boom cylinder 26 through the first supply line SL1 at a flow rate corresponding to the stroke, namely, a boom lowering flow rate, and so as to form an opening that allows hydraulic oil to return to the tank from the head-side chamber 26*h* of the boom cylinder 26. The boom cylinder 26 is thereby driven in the boom lowering direction, that is, in the contraction direction in this embodiment.

In other words, the boom flow rate control valve 36 simultaneously forms a head-side opening 36*h* and a rod-side opening 36*r* communicated with the head-side chamber 26*h* and the rod-side chamber 26*r* of the boom cylinder 26 at the boom raising position and the boom lowering position, respectively, as shown in FIGS. 5 to 8, and change respective areas of the openings (throttle openings) 36*h* and 36*r*, namely, the throttle opening areas, (throttle opening) by the stroke of the spool corresponding to the boom-raising and boom-lowering pilot pressures.

In this embodiment, thus, out of the first and second hydraulic pumps 31 and 32, the first hydraulic pump 31 corresponds to a "boom drive hydraulic pump" that discharges hydraulic oil to be supplied to the boom cylinder 26.

The arm flow rate control valve 37 is interposed between the second hydraulic pump 32 and the arm cylinder 27, and performs opening and closing motions so as to change an arm flow rate that is the flow rate of hydraulic oil supplied from the second hydraulic pump 32 to the arm cylinder 27. Specifically, the arm flow rate control valve 37 is formed of a pilot operated three-position direction selector valve having an arm crowding pilot port 37*a* and an arm pushing pilot port 37*b*, being disposed in the second center bypass line CL2 that is connected to the second hydraulic pump 32.

The arm flow rate control valve 37 includes a not-graphically-shown casing and a spool loaded to the sleeve while allowed to stroke. The spool is set to a neutral position with no pilot pressure input to any of the arm crowding and arm pushing pilot ports 37*a* and 37*b*, closing the second center bypass line CL2 and blocking the communication between the second hydraulic pump 32 and the arm cylinder 27. The arm cylinder 27 is thereby kept stopped. Meanwhile, the hydraulic oil discharged from the second hydraulic pump 32 is released to the tank through a not-graphically-shown unload valve.

By input of an arm crowding pilot pressure to the arm crowding pilot port 37*a*, the spool of the arm flow rate control valve 37 is shifted from the neutral position to an arm crowding position by a stroke corresponding to the magnitude of the arm crowding pilot pressure. This causes the arm flow rate control valve 37 to be opened so as to allow hydraulic oil to be supplied from the second hydraulic pump 32 to the head-side chamber 27*h* of the arm cylinder 27 through the second supply line SL2 branched off from the second center bypass line CL2 at the flow rate corresponding to the stroke, namely, an arm crowding flow rate, and so as to allow hydraulic oil to return to the tank from the rod-side chamber 27*r* of the arm cylinder 27. This valve opening causes the arm cylinder 27 to be driven in the arm crowding direction at a speed corresponding to the arm crowding pilot pressure.

By input of an arm pushing pilot pressure to the arm pushing pilot port 37*b*, conversely, the arm flow rate control valve 37 is shifted from the neutral position to an arm pushing position by a stroke corresponding to the magnitude of the arm pushing pilot pressure, thus being opened to allow hydraulic oil to be supplied to the rod-side chamber 27*r* of the arm cylinder 27 from the second hydraulic pump 32 through the second supply line SL2 at a flow rate corresponding to the stroke, namely, an arm pushing flow rate, and so as to allow hydraulic oil to return to the tank from the head-side chamber 27*h* of the arm cylinder 27. The arm cylinder 27 is thereby driven in the arm pushing direction at a speed corresponding to the arm pushing pilot pressure.

The bucket flow rate control valve 38 is arranged in parallel with the boom flow rate control valve 36 and interposed between the first hydraulic pump 31 and the bucket cylinder 28, and performs opening and closing motions so as to change a bucket flow rate which is the flow rate of hydraulic oil supplied from the first hydraulic pump 31 to the bucket cylinder 28. Specifically, the bucket flow rate control valve 38 is formed of a pilot operated three-position direction selector valve having a bucket crowding pilot port 38*a* and a bucket dumping pilot port 38*b*, disposed in the first center bypass line CL1 that is connected to the first hydraulic pump 31.

The bucket flow rate control valve 38 includes a not-graphically-shown casing and a spool loaded to the casing while allowed to stroke. The spool is set to a neutral position with no pilot pressure input to any of the bucket crowding and bucket dumping pilot ports 38*a* and 38*b*, closing the first center bypass line CL1 and blocking the communication between the first hydraulic pump 31 and the bucket cylinder 28. The bucket cylinder 28 is thereby kept stopped.

By input of a bucket crowding pilot pressure to the bucket crowding pilot port 38*a*, the spool of the bucket flow rate control valve 38 is shifted from the neutral position to a bucket crowding position by a stroke corresponding to the magnitude of the bucket crowding pilot pressure. This causes the bucket flow rate control valve 38 to be opened so as to allow hydraulic oil to be supplied from the first hydraulic pump 31 to the head-side chamber 28*h* of the bucket cylinder 28 through the first supply line SL1 at a flow rate corresponding to the stroke, namely, a bucket crowding flow rate, and so as to allow hydraulic oil to return to the tank from the rod-side chamber 28*r* of the bucket cylinder 28. This valve opening causes the bucket cylinder 28 to be driven in the bucket crowding direction at a speed corresponding to the bucket crowding pilot pressure.

By input of a bucket dumping pilot pressure to the bucket dumping pilot port 38*b*, conversely, the bucket flow rate control valve 38 is shifted from the neutral position to a bucket dumping position by a stroke corresponding to the magnitude of the bucket dumping pilot pressure, thus being opened so as to allow hydraulic oil to be supplied to the rod-side chamber 28*r* of the bucket cylinder 28 from the first hydraulic pump 31 through the first supply line SL1 at a flow rate corresponding to the stroke, namely, a bucket dumping flow rate, and so as to allow hydraulic oil to return to the tank from the head-side chamber 28*h* of the bucket cylinder 28. The bucket cylinder 28 is thereby driven in the bucket dumping direction at a speed corresponding to the bucket dumping pilot pressure.

The boom operation device 46 allows a boom operation for moving the boom 21 to be applied to the boom operation device 46, allowing the boom raising pilot pressure or the boom lowering pilot pressure corresponding to the boom operation to be input to the boom flow rate control valve 36. Specifically, the boom operation device 46 includes a boom lever 46*a* allowing a rotational operation corresponding to the boom operation to be applied to the boom lever 46*a* in the operation room, and a boom pilot valve 46*b* coupled to the boom lever 46*a*.

The boom pilot valve 46*b* is interposed between each of the pilot ports 36*a* and 36*b* of the boom flow rate control valve 36 and the pilot hydraulic pressure source 40. The boom pilot valve 46*b* is opened in conjunction with the boom operation applied to the boom lever 46*a* so as to allow the boom raising pilot pressure or the boom lowering pilot pressure having a magnitude corresponding to the magnitude of the boom operation to be input from the pilot hydraulic pressure source 40 to the pilot port corresponding to the direction of the boom operation out of both the pilot ports. For example, by the application of the boom operation to the boom lever 46*a* in a direction corresponding to the boom raising motion, the boom pilot valve 46*b* is opened so as to allow the boom raising pilot pressure corresponding to the magnitude of the boom operation to be supplied to the boom raising pilot port 36*a*.

The arm operation device 47 allows an arm operation for moving the arm 22 to be applied to the arm operation device 47, allowing the arm crowding pilot pressure or the arm pushing pilot pressure corresponding to the arm operation to be input to the arm flow rate control valve 37. Specifically, the arm operation device 47 includes an arm lever 47*a* allowing a rotational operation corresponding to the arm operation to be applied to the arm lever 47*a* in the operation room, and an arm pilot valve 47*b* coupled to the arm lever 47*a*.

The arm pilot valve 47*b* is interposed between each of the pilot ports 37*a* and 37*b* of the arm flow rate control valve 37 and the pilot hydraulic pressure source 40. The arm pilot valve 47*b* is opened in conjunction with the arm operation applied to the arm lever 47*a* so as to allow the arm crowding pilot pressure or the arm pushing pilot pressure having a magnitude corresponding to the magnitude of the arm operation to be input from the pilot hydraulic pressure source 40 to the pilot port corresponding to the direction of the arm operation out of both the pilot ports. For example, by the application of the arm operation in the direction corresponding to the arm crowding movement to the arm lever 47*a*, the arm pilot valve 47*b* is opened so as to allow the arm crowding pilot pressure corresponding to the magnitude of the arm operation to be supplied to the arm crowding pilot port 37*a*.

The bucket operation device 48 receives a bucket operation for moving the bucket 24, allowing the bucket crowding pilot pressure or the bucket dumping pilot pressure corresponding to the bucket operation to be input to the bucket flow rate control valve 38. Specifically, the bucket operation device 48 includes a bucket lever 48*a* allowing a rotational operation corresponding to the bucket operation to be applied to the bucket lever 48*a* in the operation room, and a bucket pilot valve 48*b* coupled to the bucket lever 48*a*.

The bucket pilot valve 48*b* is interposed between each of the pilot ports 38*a* and 38*b* of the bucket flow rate control valve 38 and the pilot hydraulic pressure source 40. The bucket pilot valve 48*b* is opened in conjunction with the bucket operation applied to the bucket lever 48*a* so as to allow the bucket crowding pilot pressure or the bucket dumping pilot pressure having a magnitude corresponding to the magnitude of the bucket operation to be input from the pilot hydraulic pressure source 40 to the pilot port corresponding to the direction of the bucket operation out of both the pilot ports. For example, by application of the bucket operation in a direction corresponding to the bucket crowding operation to the bucket lever 48*a*, the bucket pilot valve 48*b* is opened so as to allow the bucket crowding pilot pressure corresponding to the magnitude of the bucket operation to be supplied to the bucket crowding pilot port 38*a*.

The hydraulic drive apparatus further includes a first pump pressure sensor 51, a second pump pressure sensor 52, an engine rotational speed sensor 53, a boom cylinder head-pressure sensor 56H, a boom cylinder rod-pressure sensor 56R, a work device posture detection part 60, and a mode selection switch 120.

The first pump pressure sensor 51 corresponds to a pump pressure detector that detects a first pump pressure P1 which is the discharge pressure of the first hydraulic pump 31. The second pump pressure sensor 52 detects a second pump pressure P2 which is the discharge pressure of the second hydraulic pump 32.

The engine rotational speed sensor 53, which detects the rotational speed of the engine that drives the first and second hydraulic pumps 31 and 32, corresponds to a pump rotational speed detector that detects the pump rotational speed which is the rotational speed of the boom driving hydraulic pump according to the present invention. In this embodiment, where the rotational speed of the engine is equal to the rotational speed of the first hydraulic pump 31 that is the boom driving hydraulic pump, the engine rotational speed detected by the engine rotational speed sensor 53 is considered as the pump rotational speed as it is.

The aforementioned "pump speed detector" is, however, not limited to the engine rotational speed sensor 53. The pump speed detector may be also one that directly detects the rotational speed of the boom driving hydraulic pump. Alternatively, in the case including a reduction gear interposed between a power source such as the engine and a boom driving hydraulic pump, it is possible to calculate the pump speed based on a detection signal generated by the rotation speed sensor that detects the rotation speed of the power source and a reduction ratio in the reduction gear. Thus, even when the rotational speed of the power source and the rotational speed of the boom driving hydraulic pump are different from each other, the rotational speed sensor for detecting the rotational speed of the power source can serve as a "pump rotational speed detector" under the condition where the relationship between the rotational speeds of both can be determined.

Besides, the "power source" for driving the boom driving hydraulic pump is not limited to the engine. The power source may be, for example, an electric motor. The present invention also encompasses a mode where both an engine and an electric motor are used in combination as the power source as in a hybrid construction machine.

The boom cylinder head-pressure sensor 56H and the boom cylinder rod-pressure sensor 56R constitute a boom cylinder pressure detector. Specifically, the boom cylinder head-pressure sensor 56H detects a boom cylinder head pressure Ph which is the pressure of hydraulic oil in the head-side chamber 26*h* of the boom cylinder 26, and the boom cylinder rod-pressure sensor 56R detects a boom cylinder rod pressure Pr which is the pressure of hydraulic oil in the rod-side chamber 26*r* of the boom cylinder 26.

Each of the sensors 51, 52, 56H and 56R converts the detected physical quantity to a detection signal which is an electrical signal corresponding thereto and inputs the detection signal to the controller 100.

The work device posture detection part 60 detects posture information which is information for determining the posture of the work device 14. Specifically, the work device posture detection part 60 includes, as shown in FIG. 1, a boom angle sensor 61, an arm angle sensor 62, a bucket angle sensor 64 and a body inclination sensor 65. The boom angle sensor 61 detects a boom angle by which the boom 21 is raised relatively to the machine body; the arm angle sensor 62 detects an arm angle which is the rotation angle of the arm 22 to the boom 21; the bucket angle sensor 64 detects a bucket angle which is the rotation angle of the bucket 24 to the arm 22; and the body inclination sensor 65 detects the inclination angle of the upper turning body 12. Respective electrical signals generated by the sensors 61, 62, 64, 65, namely, angle detection signals, are also input to the controller 100.

The mode selection switch 120 is disposed in the operation room and electrically connected to the controller 100. The mode selection switch 120 receives an operation applied by an operator for selecting the control mode of the controller 100 between a manual operation mode and an automatic control mode, and inputs a mode command signal corresponding to the operation to the controller 100.

The controller 100 is switched between the manual operation mode and the automatic control mode in accordance with the mode command signal that is input from the mode selection switch 120. In the manual operation mode, the controller 100 allows the boom flow rate control valve 36, the arm flow rate control valve 37, and the bucket flow rate control valve 38 to operate so as to change the boom flow rate, the arm flow rate, and the bucket flow rate, in response to the boom operation, the arm operation, and the bucket operation, which are applied by the operator to the boom operation device 46, the arm operation device 47, and the bucket operation device 48, respectively. On the other hand, the controller 100 is configured to perform, in the automatic control mode, an automatic control of respective operations of the boom cylinder 26 (in this embodiment, the boom cylinder 26 and the bucket cylinder 28) in accordance with the expansion and contraction of the arm cylinder 27 to make the construction surface formed by the bucket 24 along with the movement of the arm 22 corresponding to the arm operation closer to a target construction surface that is set in advance.

Specifically, as means for enabling the controller 100 to perform the automatic control of the boom cylinder 26 and the bucket cylinder 28, the hydraulic drive apparatus further includes a boom raising flow rate operation valve 76A, a boom lowering flow rate operation valve 76B, a bucket dumping flow rate operation valve 78, shuttle valves 71A and 71B, and a shuttle valve 72.

The boom raising flow rate operation valve 76A is interposed between the pilot hydraulic pressure source 40 and the boom raising pilot port 36*a*, while being arranged in parallel with the boom operation device 46, to reduce the pilot pressure input from the pilot hydraulic pressure source 40 to the boom raising pilot port 36*a*, in response to a boom flow rate command signal that is input from the controller 100, independently of the boom operation device 46. This enables the controller 100 to automatically operate the pilot pressure that is input to the boom raising pilot port 36*a* through the boom raising flow rate operation valve 76A. The shuttle valve 71A is interposed between each of the boom operation device 46 and the boom raising flow rate operation valve 76A and the boom raising pilot port 36*a*, and opened so as to allow a higher secondary pressure to be finally input to the boom raising pilot port 36*a* as the boom raising pilot pressure, the higher secondary pressure being higher than the other secondary pressure out of the secondary pressure of the boom operation device 46 and the secondary pressure of the boom raising flow rate operation valve 76A.

Similarly, the boom lowering flow rate operation valve 76B is interposed between the pilot hydraulic pressure source 40 and the boom lowering pilot port 36*b*, while being arranged in parallel with the boom operation device 46, to reduce the pilot pressure to be input from the pilot hydraulic pressure source 40 to the boom lowering pilot port 36*b*, in response to the boom flow rate command signal input from the controller 100, independently of the boom operation device 46. This enables the controller 100 to automatically operate the pilot pressure that is input to the boom lowering pilot port 36*b* through the boom lowering flow rate operation valve 76B. The shuttle valve 71B is interposed between each of the boom operation device 46 and the boom lowering flow rate operation valve 76B and the boom lowering pilot port 36*b*, and opened so as to allow a higher secondary pressure to be finally input to the boom lowering pilot port 36*b* as the boom lowering pilot pressure, the higher secondary pressure being higher than the other secondary pressure out of the secondary pressure of the boom operation device 46 and the secondary pressure of the boom lowering flow rate operation valve 76B.

The bucket dumping flow rate operation valve 78 is interposed between the pilot hydraulic pressure source 40 and the bucket dumping pilot port 38*b*, while being arranged in parallel with the bucket operation device 48, to reduce the pilot pressure to be input from the pilot hydraulic pressure source 40 to the bucket dumping pilot port 38*b*, in response to a bucket dumping flow rate command signal input from the controller 100, independently of the bucket operation device 48. This enables the controller 100 to automatically operate the pilot pressure that is input to the bucket dumping pilot port 38*b* through the bucket dumping flow rate operation valve 78. The shuttle valve 72 is interposed between each of the bucket operation device 48 and the bucket dumping flow rate operation valve 78 and the bucket dumping pilot port 38*b* and opened so as to allow a higher secondary pressure to be finally input to the bucket dumping pilot port 38*b* as the bucket dumping pilot pressure, the higher secondary pressure being higher the other secondary pressure out of the secondary pressure of the bucket operation device 48 and the secondary pressure of the bucket dumping flow rate operation valve 78.

Each of the flow rate operation valves 76A, 76B and 78 is formed of a solenoid valve (e.g., a solenoid proportional pressure-reducing valve or a solenoid inversely proportional pressure-reducing valve), which is configured to perform opening and closing motions so as to change the opening degree thereof in response to the flow rate command signal input from the controller 100 to thereby generate a pilot pressure having a magnitude corresponding to the flow rate command.

In the manual operation mode, the controller 100 makes each of the flow rate operation valves 76A, 76B and 78 substantially fully closed to thereby allow the boom, arm and bucket flow rate control valves 36, 37 and 38 to be opened and closed in conjunction with respective operations applied to the boom, arm and bucket operation devices 46, 47 and 48, respectively. On the other hand, in the automatic control mode, the controller 100 inputs a flow rate command signal to each of the flow rate operation valves 76A, 76B and 78 to thereby execute an automatic control for making respective motions of the boom cylinder 26 and the bucket cylinder 28 follow the arm crowding motion of the arm 22 caused by the contraction motion of the arm cylinder 27.

Specifically, the controller 100 includes functions for executing the automatic control, as shown in FIG. 2: namely, a target construction surface setting part 101, a cylinder length calculation part 102, a cylinder speed calculation part 103, a target cylinder speed calculation part 104, a bucket dumping flow rate command part 105, a center-of-gravity position calculation part 106, a cylinder thrust calculation part 107, a pressing force calculation part 108, a target pressing force setting part 109, a target speed correction part 110, a boom flow rate command part 111, a supply-side throttle opening calculation part 112 and a pump capacity command part 113.

The target construction surface setting part 101 stores a construction surface that is input by the target construction surface input part 122 provided in the cab 18, and inputs the construction surface to the target cylinder speed calculation part 104 as a target construction surface. This target construction surface is a surface defining a target shape of the ground which is an object to be excavated, the shape being a three-dimensional design ground shape. The target construction surface may be specified by external data such as CIM or may be set using the position of the machine body as a reference.

The cylinder length calculation part 102 calculates respective cylinder lengths of the boom cylinder 26, the arm cylinder 27, and the bucket cylinder 28 based on the posture information detected by the work device posture detection part 60. The cylinder speed calculation part 103 calculates cylinder speeds which are respective expansion and contraction speeds of the boom cylinder 26, the arm cylinder 27 and the bucket cylinder 28, through respective time differentiations of the cylinder lengths. The cylinder length calculation part 102 and the cylinder speed calculation part 103 according to this embodiment, thus, constitute a cylinder speed calculation part that calculates each of the cylinder speeds based on the posture information.

The target cylinder speed calculation part 104 calculates a target direction vector that defines a direction in which a specific portion of the bucket (e.g., the distal end portion or a portion to be connected to the distal end portion of the arm 22 in the bucket 24) is to be moved for moving the tip 25 of the bucket 24 along the target construction surface, based on the target construction surface set by the target construction surface setting part 101, and calculates a target boom cylinder speed Vbo and a target bucket cylinder speed Vko, based on each of the cylinder speeds calculated by the cylinder speed calculation part 103.

The target boom cylinder speed Vbo is a target value of the cylinder speed of the boom cylinder 26 in the boom raising direction (the speed in the extension direction, in this embodiment) for making the construction surface, which is a surface formed by the bucket 24 along with the movement of the arm 22 in the crowding direction caused by the extension of the arm cylinder 27, closer to the target construction surface, being a speed value corresponding to the cylinder speed (extension speed) of the arm cylinder 27. The value of the target boom cylinder speed Vbo, hence, is set to positive (+) when the direction of the target boom cylinder speed Vbo is the expansion direction. The target bucket cylinder speed Vko is a target value of the cylinder speed in the bucket dumping direction of the bucket cylinder 28 (in this embodiment, the speed in the contraction direction) for keeping the posture of the bucket 24 constant regardless of the movement of the arm 22 in the crowding direction, that is, for bringing the bucket 24 into parallel movement along the target construction surface.

The target cylinder speed calculation part 104, thus, constitutes a target boom cylinder speed calculation part according to the present invention. Meanwhile, the calculation of the target bucket cylinder speed Vko is optional. For example, the target boom cylinder speed Vbo may be calculated on the premise that the bucket cylinder 28 is stationary, i.e., that the angle of the bucket 24 to the arm 22 is fixed.

The bucket dumping flow rate command part 105 calculates a target bucket dumping flow rate for obtaining the target bucket cylinder speed Vko, that is, the flow rate of hydraulic oil to be supplied to the rod-side chamber 28*r* of the bucket cylinder 28, generates a bucket dumping flow rate command signal for providing the target bucket dumping flow rate and inputs the signal to the bucket dumping flow rate operation valve 78. The bucket dumping flow rate operation valve 78 is opened at an opening degree corresponding to the bucket dumping flow rate command signal, thereby adjusting the pilot pressure to be input to the bucket dumping pilot port 38*b* of the bucket flow rate control valve 38 to a pilot pressure that provides the target bucket dumping flow rate.

There can be also a mode where the target bucket cylinder speed Vko is not calculated in the target cylinder speed calculation part 104, that is, a mode without the automatic control of the bucket cylinder 28, which mode requires neither the bucket dumping flow rate command part 105 nor the bucket dumping flow rate operation valve 78.

On the other hand, the cylinder length calculation part 102 constitutes a pressing force calculation part that calculates the pressing force Fp by which the bucket 24 is pressed against the construction surface, in cooperation with the center-of-gravity position calculation part 106, the cylinder thrust calculation part 107 and the pressing force calculation part 108.

Specifically, the center-of-gravity position calculation part 106 calculates respective center-of-gravity positions of the boom 21, the arm 22 and the bucket 24, based on each of the cylinder length calculated by the cylinder length calculation part 102.

The cylinder thrust calculation part 107 calculates the cylinder thrust Fct of the boom cylinder 26 based on the head pressure Ph and the rod pressure Pr detected by the boom cylinder head-pressure sensor 56H and the boom cylinder rod-pressure sensor 56R, respectively. The cylinder thrust Fct is represented by the following formula when the thrust in the expansion direction of the boom cylinder 26 is positive.

$$Fct=Ph*Ah-Pr*Ar$$

In this formula, Ah is the cross-sectional area of the head-side chamber 26*h* of the boom cylinder 26, and Ar is the cross-sectional area of the rod-side chamber 26*r*, wherein the cross-sectional area Ar of the rod-side chamber 26*r* is generally smaller than the cross-sectional area Ah of the head-side chamber 26*h* by the cross-sectional area of the cylinder rod.

The pressing force calculation part 108 calculates a downward moment Mw due to the self-weight of the work device 14 about the boom foot of the boom 21, which is the pivot of the work device 14, based on the respective center-of-gravity positions of the boom 21, the arm 22, and the bucket 24 calculated by the center-of-gravity position calculation part 106, and a moment Mct by the cylinder thrust Fct (an upward moment when the cylinder thrust Fct is positive), and calculates the pressing force Fp, which is a force pressing the tip 25 of the bucket 24 against the construction surface, based on both the moments Mw and Mct.

The target pressing force setting part 109 stores the pressing force that is input by the target pressing force input part 124 provided in the cab 18 and inputs the stored one to the target speed correction part 110 as a target pressing force Fpo. The value of the target pressing force Fpo, for example, may be a value that is input through an operation of ten keys or the like by the operator; alternatively, the pressing force Fp which is calculated by the pressing force calculation part 108 at the time when an operator operates the setting switch in a state of pressing the bucket 24 against the ground through actual operation of the work device 14 may be set to the target pressing force Fpo.

The target speed correction part 110 calculates a deviation ΔFp (=Fp−Fpo) of the pressing force Fp calculated by the pressing force calculation part 108 from the target pressing force Fpo, and corrects the target boom cylinder speed Vbo in a direction to make the deviation ΔFp closer to 0. In short, performed is such correction of the target boom cylinder speed Vbo as to make the pressing force Fp closer to the target pressing force Fpo.

The boom flow rate command part 111 constitutes a boom flow rate operation part in cooperation with the boom raising flow rate operation valve 76A and the boom lowering flow rate operation valve 76B. The boom flow rate operation part operates the boom flow rate control valve 36 to provide the target boom cylinder speed Vbo that has been already corrected by the target speed correction part 110. Specifically, the boom flow rate command part 111 calculates a target boom raising flow rate or a target boom lowering flow rate for providing the corrected target boom cylinder speed Vbo, generates a boom raising flow rate command signal for providing the target boom raising flow rate and inputs the signal to the boom raising flow rate operation valve 76A or generates a boom lowering flow rate command signal for providing the target boom lowering flow rate and inputs the signal to the boom lowering flow rate operation valve 76B.

As the feature of the apparatus, the boom flow rate command part 111 performs the following arithmetic control operation.

(a) When the direction of the target boom cylinder speed Vbo coincides with the direction of the cylinder thrust Fct (i.e., when both directions are the cylinder expansion directions or both directions are the cylinder contraction directions; in this embodiment, both the values of the target boom cylinder speed Vbo and the cylinder thrust Fct are positive or are negative), the boom flow rate command part 111 inputs the boom raising flow rate command signal or the boom lowering flow rate command signal corresponding to a target supply flow rate to the flow rate control valve that operates the opening of the supply side of the boom flow rate control valve 36 out of the boom raising flow rate operation valve 76A and the boom lowering flow rate operation valve 76B, so as to make the flow rate of hydraulic oil supplied from the first hydraulic pump 31 to the boom cylinder 26 be the target supply flow rate that corresponds to the target boom cylinder speed Vbo.

Figure 5:
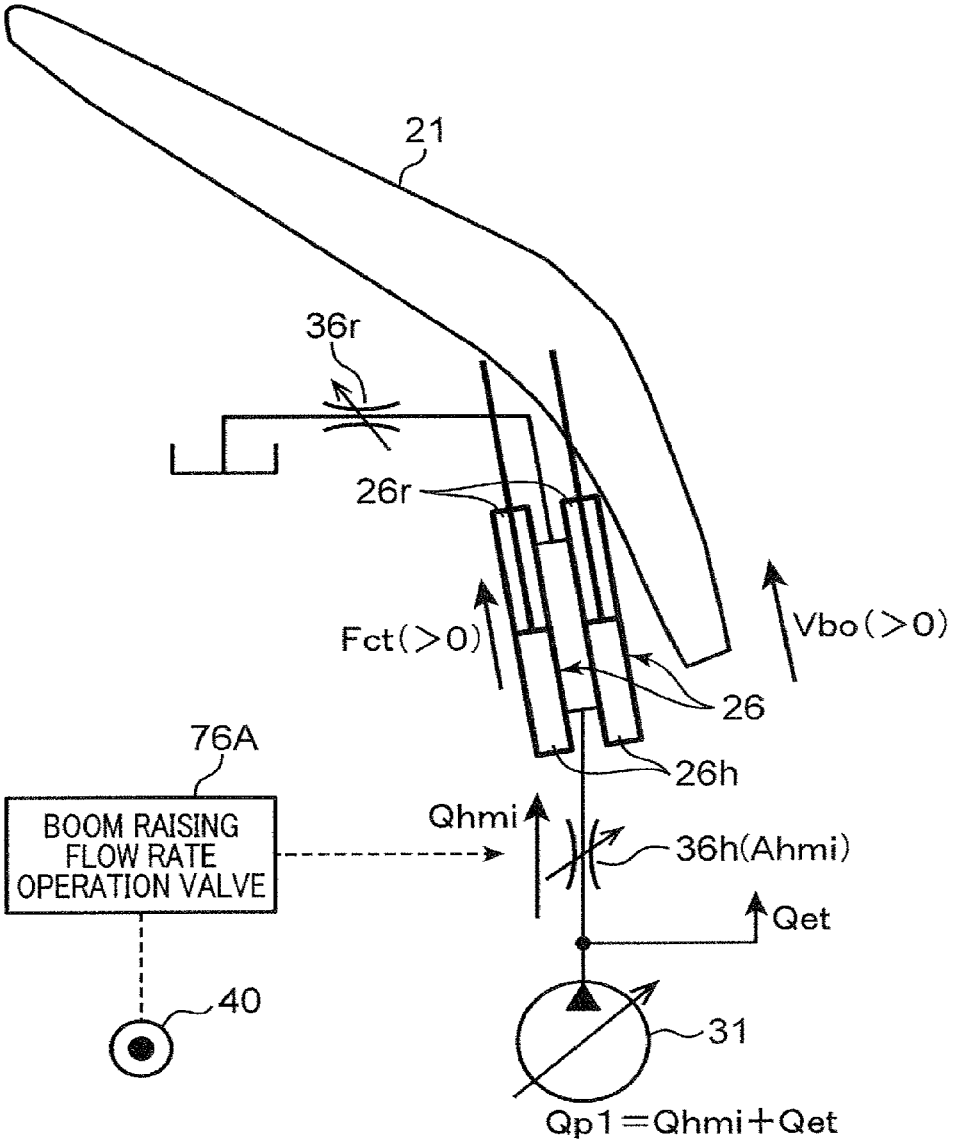
FIG. 5 is a diagram showing an opening to be operated and a pump capacity to be set when both the direction of the target boom cylinder speed calculated for a pair of boom cylinders included in the hydraulic drive apparatus and the direction of the cylinder thrust of the boom cylinder are expansion directions.
Figure 8:
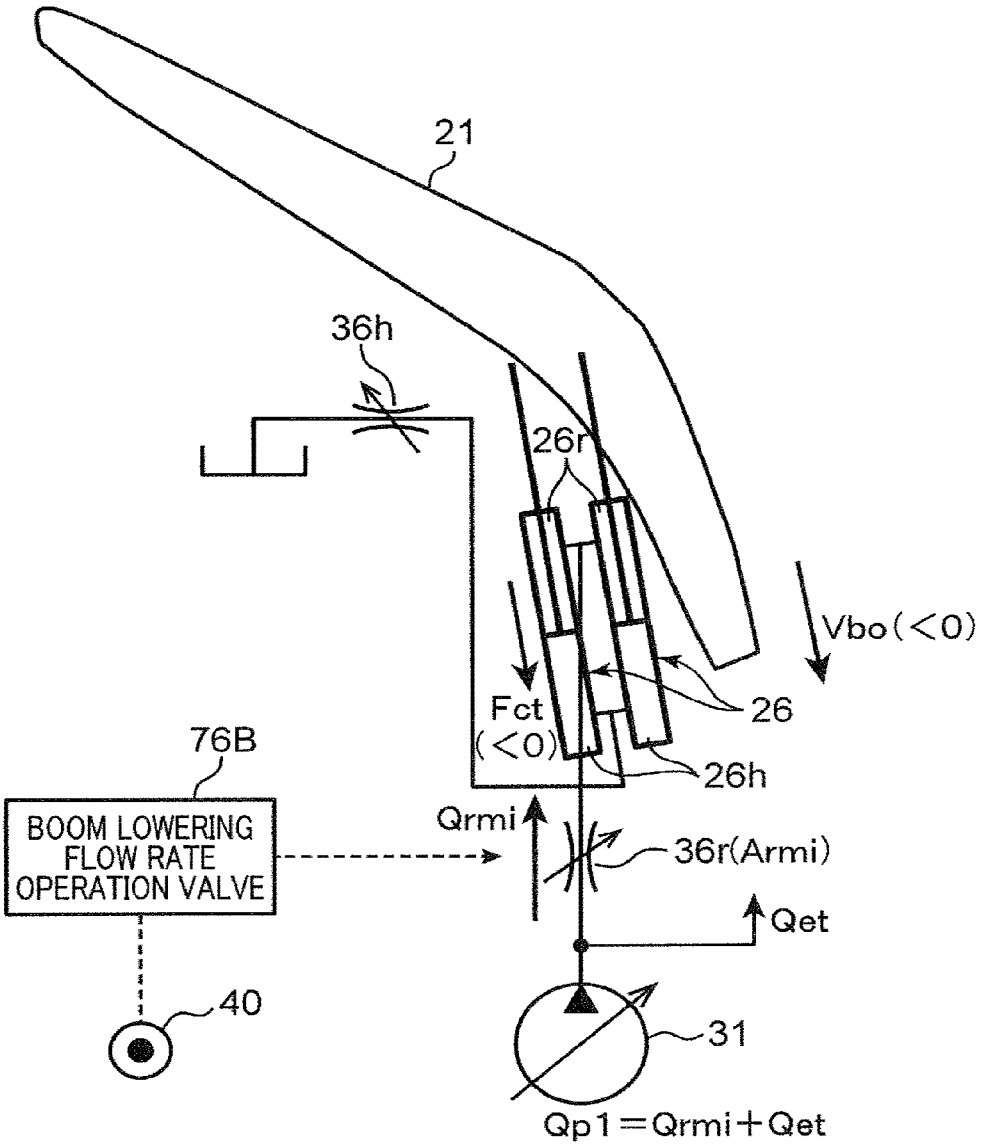
FIG. 8 is a diagram showing an opening to be operated and a pump capacity to be set when both the direction of the target boom cylinder speed and the direction of the cylinder thrust are contraction directions.

Specifically, in this embodiment, when both the values of the target boom cylinder speed Vbo and the value of the cylinder thrust Fct are positive as shown in FIG. 5, the corresponding valve which corresponds to "the flow rate operation valve that operates the opening on the supply side of the boom flow rate control valve 36" is the boom raising flow rate operation valve 76A that operates the opening determining the boom raising flow rate, namely, the head-side opening 36*h* communicated with the head-side chamber 26*h*, out of the openings formed in the boom flow rate control valve 36; meanwhile, when both the values of the target boom cylinder speed Vbo and the cylinder thrust Fct are negative as shown in FIG. 8, the corresponding valve is the boom lowering flow rate operation valve 76B that operates the opening determining the boom lowering flow rate, namely, the rod-side opening 36*r* communicated with the rod-side chamber 26*r*.

Figure 6:
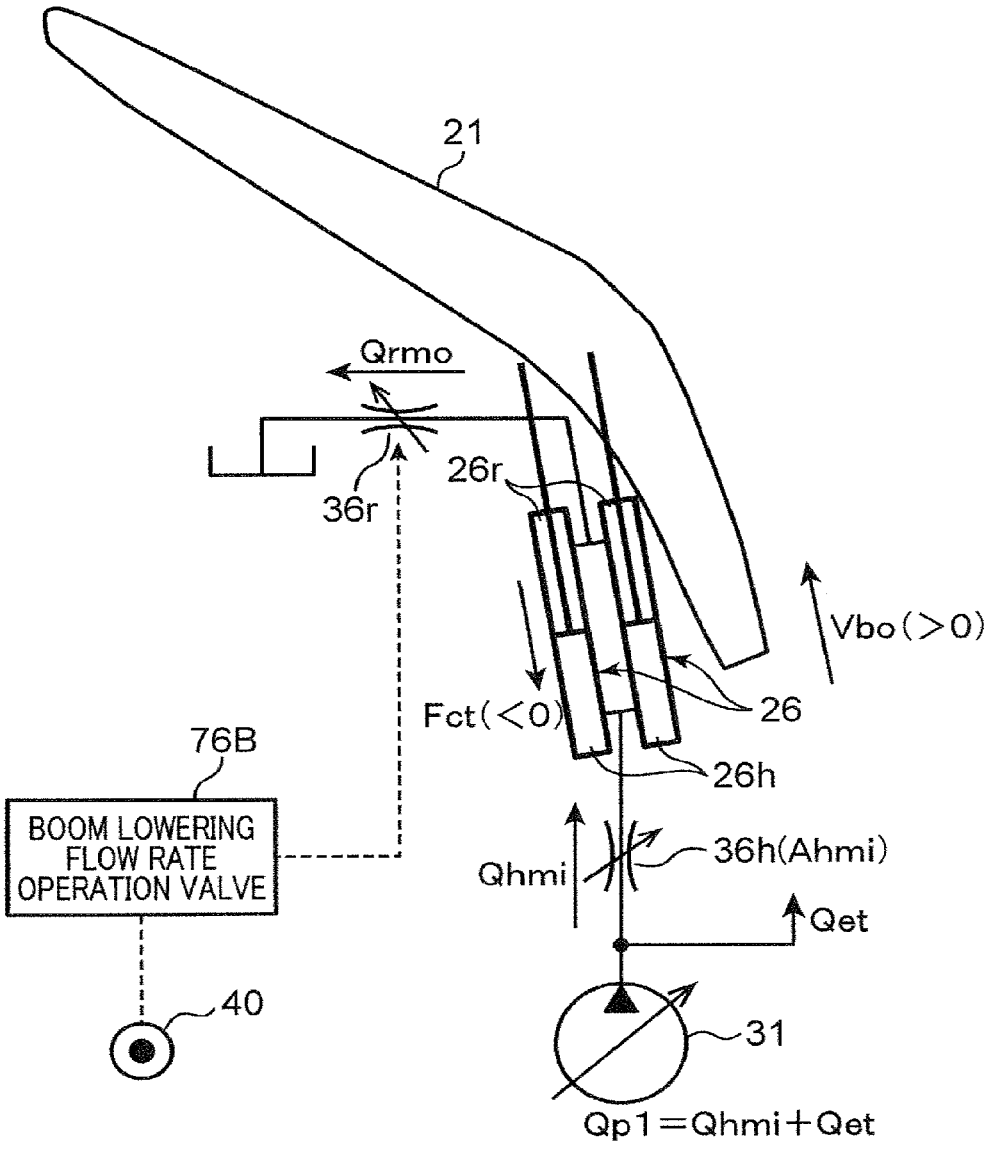
FIG. 6 is a diagram showing an opening to be operated and a pump capacity to be set when the direction of the target boom cylinder speed is an expansion direction whereas the direction of the cylinder thrust of the boom cylinder is a contraction direction.
Figure 7:
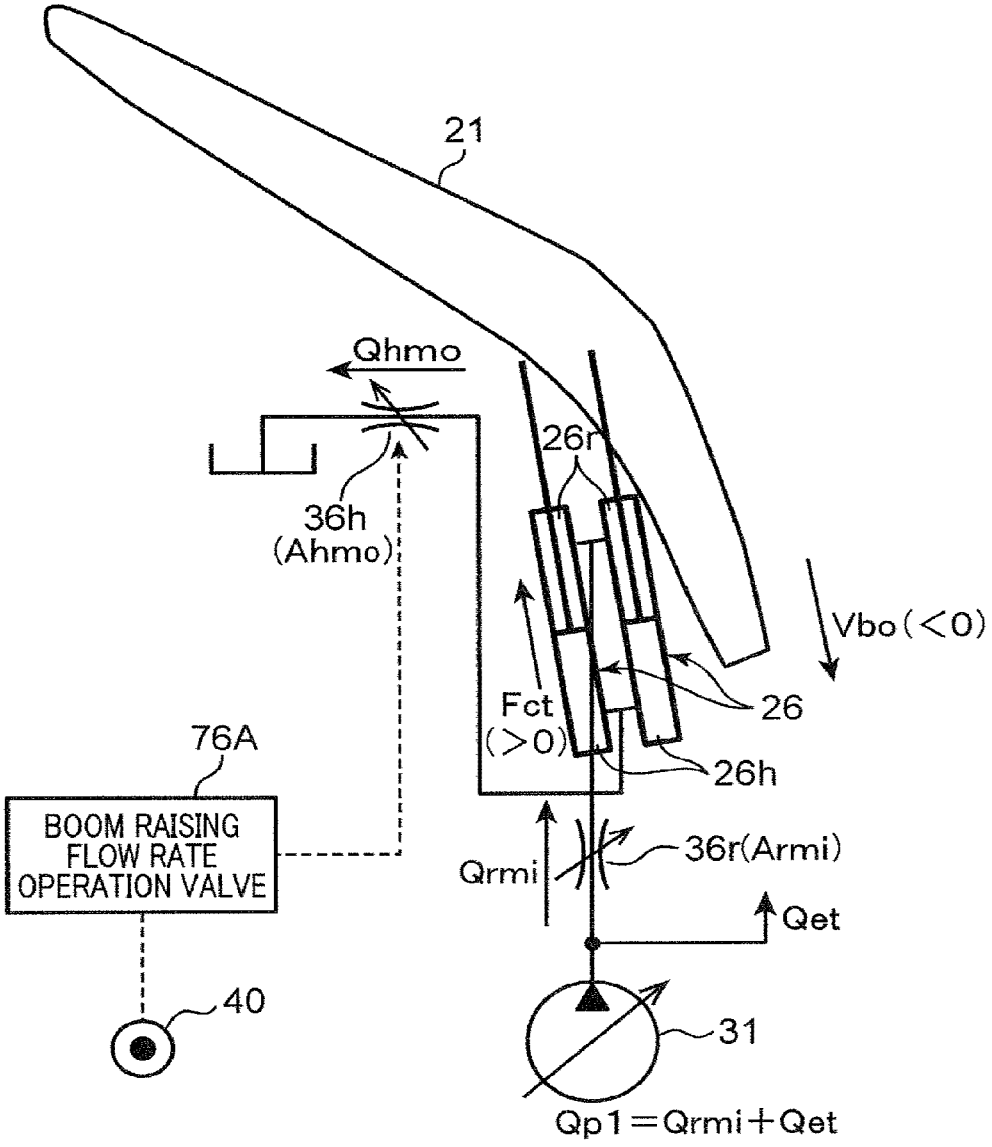
FIG. 7 is a diagram showing an opening to be operated and a pump capacity to be set when the direction of the target boom cylinder speed is a contraction direction whereas the direction of the cylinder thrust of the boom cylinder is an expansion direction.

(b) When the direction of the target boom cylinder speed Vbo is opposite to the direction of the cylinder thrust Fct (i.e., when one of the two directions is the cylinder expansion direction and the other is the cylinder contraction direction; in this embodiment, when one of the target boom cylinder speed Vbo and the value of the cylinder thrust Fct is positive and the other is negative), the boom flow rate command part 111 inputs the boom raising flow rate command signal or the boom lowering flow rate command signal corresponding to a target discharge flow rate to the flow rate control valve that operates the discharge-side opening of the boom flow rate control valve 36 out of the boom raising flow rate operation valve 76A and the boom lowering flow rate operation valve 76B so as to make the flow rate of hydraulic oil discharged from the boom cylinder 26 be the target discharge flow rate corresponding to the target boom cylinder speed Vbo. Specifically, in this embodiment, when the value of the target boom cylinder speed Vbo is positive and the value of the cylinder thrust Fct is negative as shown in FIG. 6, the corresponding valve which corresponds to the "flow rate operation valve that operates the discharge-side opening of the boom flow rate control valve 36" is the boom lowering flow rate operation valve 76B that operates the opening determining the boom lowering flow rate out of the openings formed in the boom flow rate control valve 36, namely, the rod-side opening 36*r* communicated with the rod-side chamber 26*r*; meanwhile, when the value of the target boom cylinder speed Vbo is negative and the cylinder thrust Fct is positive as shown in FIG. 7, the corresponding valve is the boom raising flow rate operation valve 76A that operates the opening determining the boom raising flow rate, namely, the head-side opening 36*h* communicated with the head-side chamber 26*h*.

Each of the boom raising flow rate operation valve 76A and the boom lowering flow rate operation valve 76B is opened by input of the boom raising flow rate command signal or the boom lowering flow rate command signal, at the opening degree corresponding to the flow rate command signal, thereby adjusting the pilot pressure to be input to the corresponding pilot port out of the boom raising and the boom lowering pilot ports 36*a* and 36*b* of the boom flow rate control valve 36 to the pilot pressure that provides the target supply flow rate or the target discharge flow rate.

In the above case (b), i.e., when the boom flow rate command part 111 controls the flow rate of hydraulic oil discharged from the boom cylinder 26, the supply-side throttle opening calculation part 112 calculates a supply-side throttle opening corresponding to the area of the supply-side opening that allows hydraulic oil to be supplied to the boom cylinder 26 from the first hydraulic pump 31, namely, a meter-in opening, out of the openings formed in the boom flow rate control valve 36. When the target boom cylinder speed Vbo is positive as shown in FIG. 6, the supply-side opening (the meter-in opening) is the head-side opening 36*h*; when the target boom cylinder speed Vbo is negative as shown in FIG. 7, the supply-side opening is the rod-side opening 36*r*.

The pump capacity command part 113, configured to change respective pump capacities of the first and second hydraulic pumps 31 and 32 in cooperation with the pump capacity operation valves 31*a* and 31*b*, constitutes a "pump capacity control part" that controls the capacity of the first hydraulic pump 31 which is the boom drive hydraulic pump, in cooperation with the supply-side throttle opening calculation part 112 and the pump capacity operation valve 31*b*. Specifically, the pump capacity command part 113 performs the following calculation control operation for the pump capacity of the first hydraulic pump 31.

(A) When the direction of the target boom cylinder speed Vbo is coincident with the direction of the cylinder thrust Fct as shown in FIGS. 5 and 8, the pump capacity command part 113 calculates such a pump capacity command signal as to change the pump capacity of the first hydraulic pump 31 to make a first pump flow rate Qp1 which is the flow rate of hydraulic oil discharged from the first hydraulic pump 31 be a flow rate corresponding to the sum of the target supply flow rate and a boom cylinder exclusion flow rate Qet, based on the engine rotational speed (that is, a pump rotational speed) detected by the engine rotational speed sensor 53, and inputs the pump capacity command signal to the pump capacity operation valve 31*b*.

When the target boom cylinder speed Vbo is positive as shown in FIG. 5, the target supply flow rate is a head-side meter-in flow rate Qhmi through the head-side opening 36*h* operated by the boom raising flow rate operation valve 76A; when the target boom cylinder speed Vbo is negative as shown in FIG. 8, the target flow rate is a rod-side meter-in flow rate Qrmi through the rod-side opening 36*r* operated by the boom lowering flow rate operation valve 76B. The boom cylinder exclusion flow rate Qct is the flow rate of hydraulic oil to be supplied from the first hydraulic pump 31 to the target except the boom cylinder 26, including the flow rate of hydraulic oil to be supplied to hydraulic actuators other than the boom cylinder 26 (in this embodiment, one or more hydraulic actuator including the bucket cylinder 28), an unload flow rate, and an amount of leakage from the hydraulic pump.

(B) When the direction of the target boom cylinder speed Vbo is opposite to the direction of the cylinder thrust Fct, the pump capacity command part 113 calculates a boom cylinder absorption flow rate which is the flow rate of hydraulic oil having passed through the meter-in opening and absorbed in the pair of boom cylinders 26, based on the supply-side throttle opening degree calculated by the supply-side throttle opening calculation part 112, that is, the opening area of the meter-in opening, calculates the pump capacity command signal for changing the pump capacity of the first hydraulic pump 31 to make the first pump flow rate Qp1 be a flow rate corresponding to the sum of the boom cylinder absorption flow rate and the boom cylinder exclusion flow rate Qet, based on the engine rotational speed (that is, a pump rotational speed) detected by the engine rotational speed sensor 53 and inputs the pump capacity command signal to the pump capacity operation valve 31*b*. When the target boom cylinder speed Vbo is positive as shown in FIG. 6, the "boom cylinder absorption flow rate" is the head-side meter-in flow rate Qhmi having passed through the head-side opening 36*h* and absorbed in the head-side chamber 26*h*; when the target boom cylinder speed Vbo is negative as shown in FIG. 7, the boom cylinder absorption flow rate is the rod-side meter-in flow rate Qrmi having passed through the rod-side opening 36*r* and absorbed in the rod-side chamber 26*r*.

Next will be described an arithmetic control operation performed by the controller 100 with respect to driving the boom cylinder 26 in the automatic control mode and the action of the hydraulic drive apparatus accompanying the same, with reference to a flowchart of FIG. 4 and FIGS. 5 to 8.

Figure 4:
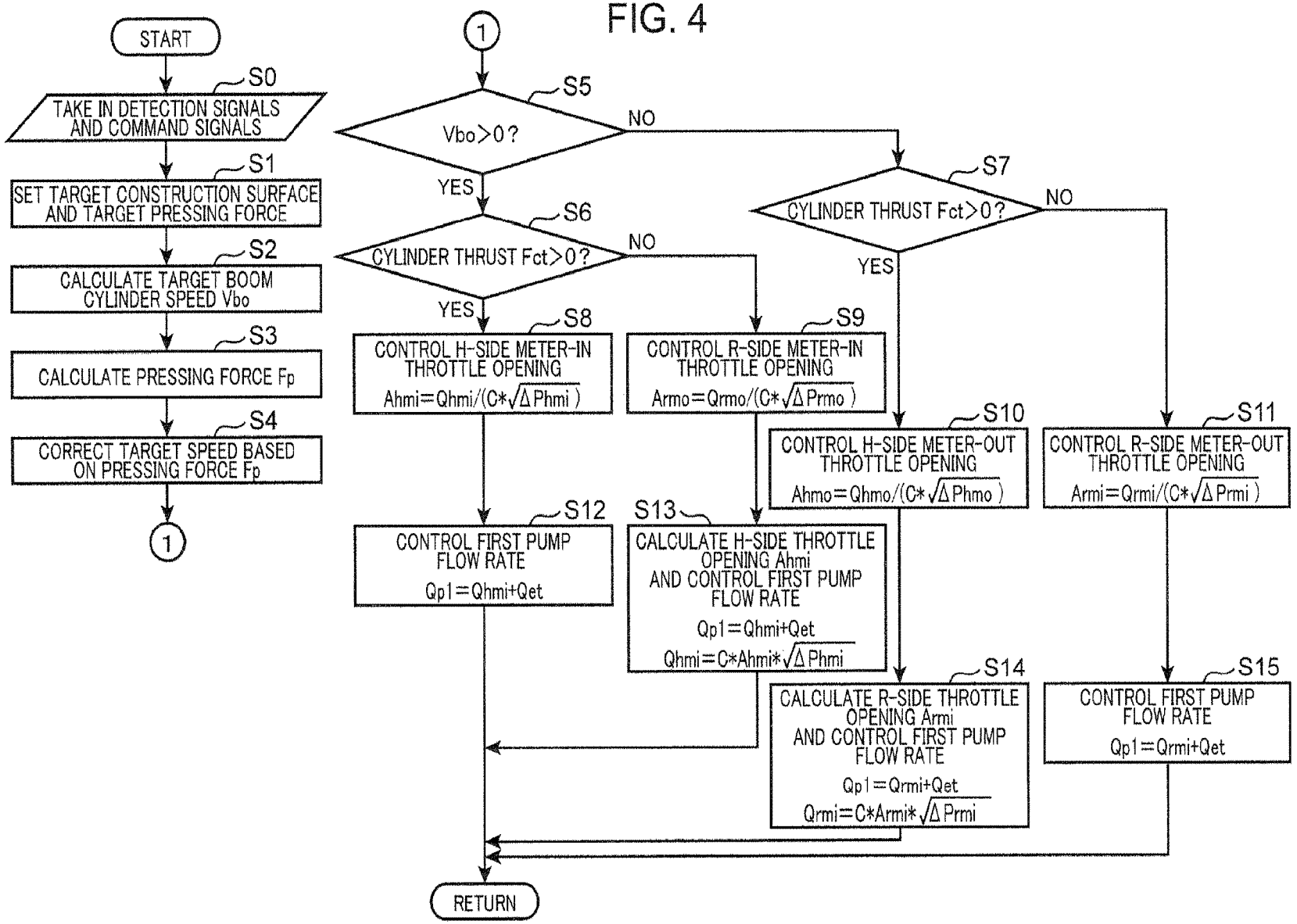
FIG. 4 is a flowchart showing an arithmetic control operation executed by the controller.

The controller 100 takes in the signals that are input to the controller 100, namely, the detection signals and the designation signals from the sensors (step S0 in FIG. 4). The designation signals include a signal on the target construction surface that is specified through the operation applied to the target construction surface input part 122 by the operator, and a signal on the target pressing force Fpo specified through the operation applied to the target pressing force input part 124. Based on these designation signals, the target construction surface setting part 101 and the target pressing force setting part 109 of the controller 100 performs settings of the target construction surface and the target pressing force Fpo, respectively (step S1).

Next, the target cylinder speed calculation part 104 of the controller 100 calculates the target boom cylinder speed Vbo corresponding to the cylinder speed of the arm cylinder 27, based on the target construction surface and the actual cylinder speed calculated by the cylinder length calculation part 102 and the cylinder speed calculation part 103 (step S2). The target boom cylinder speed Vbo is, as described above, the speed of the boom cylinder 26 in the raising direction, required for interlocking the movement of the boom 21 in the raising direction with the movement of the arm 22 in the crowding direction so as to make the construction surface by the bucket 24 closer to the target construction surface. In other words, the target boom cylinder speed Vbo is the speed at which the boom cylinder 26 should be moved to make a specific portion of the bucket 24 (e.g., the tip 25 of the bucket 24, or the proximal end portion supported by the distal end portion of the arm 22) move along the target construction surface along with the operation applied to the arm lever 47*a* in the arm crowding direction by the operator. The target boom cylinder speed Vbo, therefore, is set to a positive value with respect to the expansion direction or a negative value with respect to the contraction direction.

Meanwhile, the pressing force calculation part of the controller 100 calculates the pressing force Fp by which the tip 25 of the bucket 24 is pressed against the construction surface (step S3). Specifically, the center-of-gravity position calculation part 106 calculates respective center-of-gravity positions of the boom 21, the arm 22 and the bucket 24 based on the cylinder lengths calculated by the cylinder length calculation part 102. The cylinder thrust calculation part 107, meanwhile, calculates the cylinder thrust Fct (=Ph*Ah−Pr*Ar) of the boom cylinder 26 based on the head pressure Ph and the rod pressure Pr of the boom cylinder 26 detected by the boom cylinder head-pressure sensor 56H and the rod-pressure sensor 56R, respectively. The value of the cylinder thrust Fct is positive when the direction of the cylinder thrust Fct is the raising direction (cylinder expansion direction) in which the boom 21 is to be moved in conjunction with the movement of the arm 22 in the crowding direction. Then, the pressing force calculation part 108 calculates the downward moment Mw about the boom foot due to the self-weight of the entire work device 14 and the upward moment Mct about the boom foot due to the cylinder thrust Fct, based on the respective center-of-gravity positions, and calculates the pressing force Fp based on the difference between the moments Mw and Mct.

Furthermore, the target speed correction part 110 of the controller 100 calculates the deviation ΔFp (=Fp−Fpo) of the pressing force Fp from the target pressing force Fpo, and performs correction of the target boom cylinder speed Vbo so as to make the deviation ΔFp closer to 0 (step S4). This correction is performed, for example, by subtracting a correction amount from the target boom cylinder speed Vbo, the correction amount obtained by multiplying the deviation ΔFp by a specific gain.

Next, the boom flow rate command part 111 of the controller 100 judges the direction of the target boom cylinder speed Vbo (i.e., whether positive or negative the value of the target boom cylinder speed Vbo is) and the direction of the cylinder thrust Fct (i.e., whether positive or negative the value of the cylinder thrust Fct is) (steps S5 to S7), and generates a boom raising flow rate command signal or a boom lowering command signal to provide the target boom cylinder speed Vbo corrected as described above, based on the judgment, thereby performing control of the specific throttle opening of the boom flow rate control valve 36 (steps S8 to S11). In response to the control of the throttle opening, furthermore, the pump capacity command part 113 of the controller 100 controls the pump capacity of the first hydraulic pump 31 that is a boom driving hydraulic pump (Steps S12 to S15).

Specifically, the arithmetic and control operation performed by the controller 100 for the boom raising flow rate or the boom lowering flow rate and the pump capacity is as follows.

(I) When the target boom cylinder speed Vbo is positive (YES in step S5) and the cylinder thrust Pet is also positive (YES in step S6) as shown in FIG. 5, the boom flow rate command part 111 selects, as the throttle opening to be controlled in the boom flow rate control valve 36, the head-side meter-in throttle opening which is an opening allowing hydraulic oil to be supplied to the head-side chamber 26*h*, namely, the head-side opening 36*h*, and performs a control for the selected opening (step S8).

The reason for selecting the head-side meter-in throttle opening as the control target in this case is as follows. The state where the cylinder thrust Fct is positive, that is, the state where the thrust force due to the head pressure Ph of the boom cylinder 26 exceeds the thrust force due to the rod pressure Pr, is a state where the downward moment due to the self-weight of the work device 14 is larger than the upward moment due to the reaction force of the pressing force Fp of the bucket 24. To expand the boom cylinder 26 against the moment due to the self-weight in this state, it is required to force hydraulic oil into the head-side chamber 26*h* of the boom cylinder 26 to further increase the cylinder thrust Fct. In this state, therefore, adjustment of the opening degree of the head-side opening 36*h* which is a head-side meter-in throttle opening determining the flow rate of the hydraulic oil supplied to the head-side chamber 26*h* enables the expansion speed of the boom cylinder 26 to be controlled with high accuracy.

The boom flow rate command part 111, accordingly, calculates the opening degree (opening area) of the head-side meter-in throttle opening (head-side opening 36*h*) Ahmi based on the following formula (1), generates the boom raising flow rate command signal for providing the opening degree and inputs the signal to the boom raising flow rate operation valve 76A.

$$Ahmi=Qhmi/(C*\sqrt{\Delta Phmi}) \quad (1)$$

In the formula (1), Qhmi is a head-side target supply flow rate (head-side target meter-in flow rate) which is the flow rate of hydraulic oil to be supplied to the head-side chamber 26*h* for providing the target boom cylinder speed Vbo; C is a flow rate coefficient; and ΔPhmi is the differential pressure across the head-side opening 36*h*, corresponding to the difference between the first pump pressure P1 and the head pressure Ph (ΔPhmi=P1−Ph).

The boom raising flow rate operation valve 76A is opened so as to allow the boom raising pilot pressure having a magnitude corresponding to the boom raising flow rate command signal to be input to the boom raising pilot port 36*a* of the boom flow rate control valve 36 through the boom raising flow rate operation valve 76A. The boom flow rate control valve 36 is thereby opened to form a head-side opening 36*h* having the head-side meter-in opening area Ahmi. The meter-in flow rate of the boom cylinder 26 is thus controlled.

The pump capacity command part 113 of the controller 100, furthermore, performs control of the first pump flow rate Qp1 corresponding to the throttle opening control (step S12). Specifically, the pump capacity command part 113 generates a pump capacity command signal for changing the pump capacity of the first hydraulic pump 31 so as to make the first pump flow rate Qp1 be the flow rate corresponding to the sum of the head-side meter-in flow Qhmi, which is the target supply flow rate, and the boom cylinder exclusion flow rate Qet which is the flow rate of hydraulic oil to be supplied to the objects other than the boom cylinder 26, i.e., so as to establish the relationship Qp1=Qhmi+Qet, and inputs the signal to the pump capacity operation valve 31*a* of the first hydraulic pump 31.

(II) When the target boom cylinder speed Vbo is positive (YES in step S5) whereas the cylinder thrust Fct is negative (NO in step S6) as shown in FIG. 6, the boom flow rate command part 111 selects, as the throttle opening to be controlled in the boom flow rate control valve 36, the rod-side meter-out throttle opening that allows hydraulic oil to be discharged from the rod-side chamber 26*r*, namely, the rod-side opening 36*r*, and perform the control thereof (step S9).

The reason for selecting the rod-side meter-out throttle opening as the control object in this case is as follows. The state where the cylinder thrust Fct is negative, that is, the state where the thrust force due to the rod pressure Pr is larger than the thrust force by the head pressure Ph, is a state where the upward moment due to the reaction force of the pressing force Fp of the bucket 24 is so large that upward load acts on the boom 21 against the self-weight of the boom 21. In this state, it is required to control the speed at which the boom cylinder 26 expands in the direction of the load opposite to the direction of the cylinder thrust Fct. In this state, where the pressure of hydraulic oil discharged from the rod-side chamber 26*r* serves as the holding pressure, adjustment of the opening degree of the rod-side opening 36*r* which is the rod-side meter-out throttle opening determining the flow rate of the discharged hydraulic oil allows the expansion speed of the boom cylinder 26 to be controlled with high accuracy.

The boom flow rate command part 111, accordingly, calculates the opening degree (opening area) of the rod-side meter-out throttle opening (rod-side opening 36*r*) Armo based on the following formula (2), generates the boom lowering flow rate command signal for providing the opening degree and inputs the signal to the valve 76B.

$$Armo=Qrmo/(C*\sqrt{\Delta Prmo}) \quad (2)$$

In this formula (2), Qrmo is the rod-side target discharge flow rate (target meter-out flow rate) that is the flow rate of the hydraulic oil discharged from the rod-side chamber 26*r* and required to be limited for providing the target boom cylinder speed Vbo. ΔPrmo is a differential pressure across the rod-side opening 36*r*, corresponding to the difference between the rod pressure Pr and the tank pressure Po (ΔPrmo=Pr−Po).

The boom lowering flow rate operation valve 76B is opened so as to allow the boom lowering pilot pressure having a magnitude corresponding to the boom lowering flow rate command signal to be input to the boom lowering pilot port 36*b* of the boom flow rate control valve 36 through the boom lowering flow rate operation valve 76B. The boom flow rate control valve 36 is thereby opened to form the rod-side opening 36*r* having the rod-side meter-out opening area Armo. The meter-out flow rate of the boom cylinder 26 is thus controlled.

In this case, furthermore, the supply-side throttle opening calculation part 112 of the controller 100 calculates the head-side meter-in opening area Ahmi which is the opening area of the head-side opening 36*h* as the supply-side opening (head-side meter-in throttle opening), and the pump capacity command part 113 calculates the head-side meter-in flow rate Qhmi which is the flow rate of hydraulic oil absorbed in the pair of boom cylinders 26 through the head-side opening 36*h*, namely, the boom cylinder absorption flow rate, based on the opening area Ahmi, and controls the first pump flow rate Qp1 based thereon (step S13).

The reason is as follows. When the direction of the target boom cylinder speed Vbo is opposite to the direction of the cylinder thrust Fct as described above, a part of the hydraulic oil discharged from the first hydraulic pump 31 is absorbed in the boom cylinder 26 through the head-side opening 36*h*, which is the meter-in opening of the boom flow rate control valve 36, along with the motion (motion in the expansion direction) of the boom cylinder 26. Accordingly, setting the pump capacity of the first hydraulic pump 31 in anticipation of the flow rate of the absorbed hydraulic oil makes it possible to appropriately ensure the flow rate of hydraulic oil to be supplied from the first hydraulic pump 31 to the target other than the boom cylinder 26. Although the control target in this case is not the head-side opening 36*h* but the rod-side opening 36*r*, the opening area of the head-side opening 36*h* (the head-side meter-in opening area Ahmi) can be calculated based on the stroke of the spool of the boom flow rate control valve 36 corresponding to the opening area of the rod-side opening 36*r* (rod-side meter-out opening area Armo), which stroke can be determined.

The supply-side throttle opening calculation part 112, accordingly, calculates the head-side meter-in opening area Ahmi, which is the opening area of the head-side opening 36*h*, based on the rod-side meter-out opening area Armo. The pump capacity command part 113, furthermore, calculates the head-side meter-in flow rate Qhmi that is the boom cylinder absorption flow rate based on the meter-in opening area Ahmi, and generates a pump capacity command signal for the pump capacity of the first hydraulic pump 31 based on the engine rotational speed detected by the engine rotational speed sensor 53 (i.e., the pump speed) so as to make the first pump flow rate Qp10 be a flow rate corresponding to the sum of the head-side meter-in flow rate Qhmi and the boom cylinder exclusion flow rate Qet, that is, so as to establish the relationship Qp1=Qhmi+Qet, inputting the signal to the pump capacity operation valve 31*a* of the first hydraulic pump 31.

The head-side meter-in flow rate (boom cylinder absorption flow rate) Qhmi is given by the following formula (2A).

$$Qhmi=C*Ahmi*\sqrt{\Delta Phmi} \quad (2A)$$

(III) When the target boom cylinder speed Vbo is negative (NO in step S5) whereas the cylinder thrust Fct is positive (YES in step S6) as shown in FIG. 7, the boom flow rate command part 111 selects, as the throttle opening to be controlled in the boom flow rate control valve 36, the head-side meter-out throttle opening that allows hydraulic oil to be discharged from the head-side chamber 26*h*, namely, the head-side opening 36*h*, and performs the control thereof (step S10).

The reason for selecting the head-side meter-out opening as the control target in this case is the same as that in the case of (II). Specifically, in the state where the cylinder thrust Fct is positive, that is, in the state where the downward moment due to the self-weight of the work device 14 is larger than the upward moment due to the reaction force of the pressing force Fp of the bucket 24, it is required to control the speed at which the boom cylinder 26 is contracted by the downward external force acting on the boom 21 in the opposite direction to the direction of the cylinder thrust Fct, as in the case (II). In this state, where the pressure of hydraulic oil discharged from the head-side chamber 26*h* serves as the holding pressure, adjustment of the opening degree of the head-side opening 36*h*, which is the head-side meter-out throttle opening determining the flow rate of the discharged hydraulic oil, allows the contraction speed of the boom cylinder 26 to be controlled with high accuracy.

The boom flow rate command part 111, accordingly, calculates the opening degree of the head-side meter-out throttle opening (the opening area of the head-side opening 36*h*) Ahmo based on the following formula (3), generates the boom raising flow rate command signal for providing the opening degree and inputs the signal to the boom raising flow rate operation valve 76A.

$$Ahmo=Qhmo/(C*\sqrt{\Delta Phmo}) \quad (3)$$

In this formula (3), Qhmo is the flow rate of hydraulic oil discharged from the head-side chamber 26*h*, namely, the head-side target discharge flow rate (target meter-out flow rate), which should be limited to provide the target boom cylinder speed Vbo. ΔPhmo is the differential pressure across the head-side opening 36*h*, corresponding to the difference between the head pressure Ph and the tank pressure Po (ΔPhmo=Ph−Po).

The boom raising flow rate operation valve 76A is opened so as to allow the boom raising pilot pressure having a magnitude corresponding to the boom raising flow rate command signal to be input to the boom raising pilot port 36*a* of the boom flow rate control valve 36 through the boom raising flow rate operation valve 76A. The boom flow rate control valve 36 is thereby opened to form the head-side opening 36*h* having the head-side meter-out opening area Ahmo. The meter-out flow rate of the boom cylinder 26 is thus controlled.

In this case, furthermore, the supply-side throttle opening calculation part 112 of the controller 100 calculates the rod-side meter-in opening area Armi, which is the opening area of the rod-side opening 36*r* as the supply-side opening, namely, the rod-side meter-in throttle opening. The pump capacity command part 113 calculates a rod-side meter-in flow rate Qrmi which is the flow rate of hydraulic oil absorbed in the pair of boom cylinders 26 through the rod-side opening 36*r* (boom cylinder absorption flow rate) based on the opening area Armi, and performs the control of the first pump flow rate Qp1 based thereon (step S14).

The reason is the same as that in the case of (II). Specifically, since a part of the hydraulic oil discharged from the first hydraulic pump 31 is absorbed in the boom cylinder 26 through the rod-side opening 36*r*, which is the meter-in opening of the boom flow rate control valve 36, along with the motion of the boom cylinder 26 (motion in the contraction direction), setting the pump capacity of the first hydraulic pump 31 in anticipation of the flow rate of the absorbed hydraulic oil makes it possible to ensure the sufficient flow rate of hydraulic oil to be supplied from the first hydraulic pump 31 to the target other than the boom cylinder 26. Besides, the opening area of the rod-side opening 36*r* (rod-side meter-in opening area Armi) can be calculated based on the stroke of the spool of the boom flow rate control valve 36 corresponding to the opening area of the head-side opening 36*h* (head-side meter-out opening area Ahmo) that is the control target, which stroke can be determined.

The supply-side throttle opening calculation part 112, accordingly, calculates the rod-side meter-in opening area Armi, which is the opening area of the rod-side opening 36*r*, based on the head-side meter-out opening area Ahmo. The pump capacity command part 113, furthermore, calculates the rod-side meter-in flow rate Qrmi which is the boom cylinder absorption flow rate, based on the meter-in opening area Armi, generates the pump capacity command signal for the pump capacity of the first hydraulic pump 31 based on the engine rotational speed (i.e. pump speed) so as to make the first pump flow rate Qp1 be a flow rate corresponding to the sum of the rod-side meter-in flow rate Qrmi and the boom cylinder exclusion flow rate Qet, that is, so as to establish the relationship Qp1=Qrmi+Qet, and inputs the signal to the pump capacity operation valve 31*a* of the first hydraulic pump 31.

The rod-side meter-in flow rate (boom cylinder absorption flow rate) Qrmi is given by the following formula (3A).

$$Qrmi=C*Armi*\sqrt{\Delta Prmi} \quad (3A)$$

(IV) When the target boom cylinder speed Vbo is negative (NO in step S5) and the cylinder thrust Fct is also negative (NO in step S6) as shown in FIG. 8, the boom flow rate command part 111 selects, as the throttle opening to be controlled in the boom flow rate control valve 36, the rod-side meter-in throttle opening which is the opening allowing hydraulic oil to be supplied to the rod-side chamber 26*r*, namely, the rod-side opening 36*r*, and performs the control thereof (step S11).

The reason for selecting the head-side meter-in opening as the control target in this case is the same as that in the case (I). Specifically, in the state where the cylinder thrust Fct is negative, that is, in the state where the upward moment due to the reaction force of the pressing force Fp of the bucket 24 is large, it is required to force hydraulic oil into the rod-side chamber 26*r* of the boom cylinder 26 so as to increase the absolute value of the cylinder thrust Fct to contract the boom cylinder 26 against the upward moment. Hence, adjustment of the opening degree of the rod-side opening 36*r* which is a rod-side meter-in throttle opening determining the flow rate of the hydraulic oil supplied to the rod-side chamber 26*r* allows the contraction speed of the boom cylinder 26 to be controlled with high accuracy.

The boom flow rate command part 111, accordingly, calculates the opening degree (opening area) of the rod-side meter-in throttle opening (the rod-side opening 36*r*) Armi based on the following formula (4), generates the boom lowering flow rate command signal for providing the opening degree and inputs the signal to the boom lowering flow rate operation valve 76B.

$$Armi=Qrmi/(C*\sqrt{\Delta Prmi}) \quad (1)$$

In this formula (1), Qrmi is a rod-side target supply flow rate (a target meter-in flow rate) which is the flow rate of hydraulic oil to be supplied to the rod-side chamber 26*r* to provide the target boom cylinder speed Vbo, and ΔPrmi is the differential pressure across the rod-side opening 36*r*, corresponding to the difference between the first pump pressure P1 and the rod pressure Pr (ΔPhmi=P1−Ph).

The boom lowering flow rate operation valve 76B is opened so as to allow the boom lowering pilot pressure having a magnitude corresponding to the boom lowering flow rate command signal to be input to the boom lowering pilot port 36*b* of the boom flow rate control valve 36 through the boom lowering flow rate operation valve 76B. The boom flow rate control valve 36 is thereby opened to form the rod-side opening 36*r* having the rod-side meter-in opening area Armi. The meter-in flow rate of the boom cylinder 26 is thus controlled.

Furthermore, the pump capacity command part 113 of the controller 100 performs control of the first pump flow rate Qp1 corresponding to the throttle opening control (step S15). Specifically, the pump capacity command part 113 generates a pump capacity command signal for changing the pump capacity of the first hydraulic pump 31 so as to make the first pump flow rate Qp1 be a flow rate corresponding to the sum of the rod-side meter-in flow rate Qrmi, which is the target supply flow rate, and the boom cylinder exclusion flow rate Qet, i.e., so as to establish the relationship Qp1=Qrmi+Qet, and inputs the signal to the pump capacity operation valve 31*a* of the first hydraulic pump 31.

The present invention is not limited to the embodiments described above. The present invention may encompass, for example, the following aspects.

(1) Calculation of Pressing Force and Correction of Target Boom Cylinder Speed Based on Deviation Thereof In the present invention, the calculation of the pressing force Fp and the correction of the target boom cylinder speed based on the deviation ΔFp thereof are optional. Besides, in the case of performing the correction of the target boom cylinder speed based on the deviation, the calculation of the pressing force is not limited to the one described above. For example, there may be performed a simple calculation of the pressing force Fp only based on the cylinder thrust Fct of the boom cylinder 26 with regarding the self-weight of the work device 14 as being constant regardless of the posture thereof. Besides, may be corrected the target direction vector for calculating the target boom cylinder speed, in place of the target boom cylinder speed that has been already calculated.

(2) Boom Flow Rate Control Valve

The specific configuration of the boom flow rate control valve according to the present invention is not limited. Although the boom flow rate control valve 36 according to the embodiment is formed of a pilot operated there-position direction selector valve capable of changing respective opening areas of both the head-side opening 36*h* and the rod-side opening 36*r* by the stroke of the single spool, the boom flow rate control valve according to the present invention, for example, may be a combination of a head-side flow rate control valve and a rod-side flow rate control valve that form the head-side opening 36*h* and the rod-side opening 36*r* shown in FIG. 5, respectively, independently of each other. Also in this case, the boom flow rate operation part according to the present invention can provide the same effect as that of the embodiment, by selecting a control valve to be operated, out of the head-side control valve and the rod-side control valve, based on the direction of the target boom cylinder speed and the direction of the cylinder thrust.

(3) Calculation of Target Boom Cylinder Speed

The method for calculation of the target boom cylinder speed is not limited to the calculation method in the above-described embodiment. The target boom cylinder speed, for example, may be determined correspondingly to the actual posture information, based on a map prepared in advance with respect to the relationship between the posture information for determining the posture of the work device and the target boom cylinder speed.

(4) Direction of Arm Motion

Although the embodiment is intended to control the cylinder speed of the boom cylinder 26 in response to the movement of the arm 22 in the arm crowding direction, the present invention can be also applied to the control of the boom cylinder following the movement of the arm in the arm pushing direction and the reciprocating movements in the arm pushing direction and the arm crowding direction. For example, even when the control of the cylinder speed in the construction direction of the boom cylinder is performed accompanying the movement of the arm in the pushing direction, selecting the flow rate to be controlled out of the boom raising flow rate and the boom lowering flow rate (supply-side flow rate or discharge-side flow rate) based on the direction of the target boom cylinder speed and the direction of the cylinder thrust enables the same effect as described above to be obtained.

As has been described, there is provided a hydraulic drive apparatus installed in a work machine equipped with a work device including a boom, an arm, and a bucket to hydraulically actuate the work device, the hydraulic drive apparatus being capable of controlling the movement of the boom with high accuracy in accordance with the movement of the arm so as to make the construction surface by the bucket closer to a target construction surface regardless of the load acting on the boom.

Provided is a hydraulic drive apparatus installed in a work machine equipped with a machine body and a work device attached to the machine body, the work device including a boom supported on the machine body so as to be raiseable and lowerable, an arm connected to a distal end of the boom so as to be rotationally movable, and a bucket attached to a distal end of the arm to be pressed against a construction surface, to hydraulically drive the boom, the arm, and the bucket, the hydraulic drive apparatus including: a hydraulic oil supply device including at least one hydraulic pump that is driven by a driving source to thereby discharge hydraulic oil; at least one boom cylinder that is expanded and contracted by supply of hydraulic oil from the hydraulic oil supply device to thereby raise and lower the boom; an arm cylinder that is expanded and contracted by supply of hydraulic oil from the hydraulic oil supply device to thereby rotationally move the arm; a bucket cylinder that is expanded and contracted by supply of hydraulic oil from the hydraulic oil supply device to thereby rotationally move the bucket; a boom flow rate control valve interposed between the hydraulic oil supply device and the at least one boom cylinder and being capable of performing opening and closing motions to change a boom cylinder supply flow rate which is a flow rate of hydraulic oil supplied from the hydraulic oil supply device to the at least one boom cylinder and a boom cylinder discharge flow rate which is a flow rate of hydraulic oil discharged from the boom cylinder; a target construction surface setting part that sets a target construction surface defining a target shape of an object to be constructed by the bucket; a working posture detection part that detects posture information which is information for determining a posture of the work device; a boom cylinder pressure detector that detects a head pressure and a rod pressure which arc respective pressures of a head-side chamber and a rod-side chamber of the at least one boom cylinder; a cylinder speed calculation part that calculates cylinder speeds, which are respective operation speeds of the boom cylinder, the arm cylinder and the bucket cylinder, based on the posture information detected by the working posture detection part; a target boom cylinder speed calculation part that calculates a target boom cylinder speed which is a target value of an operation speed of the boom cylinder for making a surface to be constructed by the bucket along with movement of the arm caused by expansion and contraction of the arm cylinder closer to the target construction surface on the basis of the cylinder speeds calculated by the cylinder speed calculation part; and a boom flow rate operation part that operates the boom flow rate control valve to provide the target boom cylinder speed. The boom flow rate operation part is configured to operate the boom flow rate control valve to make the boom cylinder supply flow rate be a target supply flow rate corresponding to the target boom cylinder speed when a direction of the target boom cylinder speed calculated by the target boom cylinder speed calculation part coincides with a direction of a cylinder thrust which is a thrust of the boom cylinder determined by the head pressure and the rod pressure detected by the boom cylinder pressure detector, and configured to operate the boom flow rate control valve to make the boom cylinder discharge flow rate be a target discharge flow rate corresponding to the target boom cylinder speed when the direction of the target boom cylinder speed is opposite to the direction of the cylinder thrust.

Thus selecting the flow rate to be adjusted out of the boom cylinder supply flow rate and the boom cylinder discharge flow rate based on whether or not the direction of the target boom cylinder speed and the direction of the cylinder thrust is coincident with each other, the boom flow rate operation part allows the boom cylinder speed to be controlled with high accuracy, regardless of the variation of the load acting on the boom and the boom cylinder actuating the boom. This makes it possible to make the construction surface by the bucket close to the target construction surface with high accuracy.

For example, in the case where the boom flow rate control valve is a pilot operated direction selector valve having a boom raising pilot port and a boom lowering pilot port, configured to be opened by input of a boom raising pilot pressure to the boom raising pilot port at an opening degree corresponding to a magnitude of the boom raising pilot pressure so as to make the boom cylinder operate in a direction to raise the boom and configured to be opened by input of a boom lowering pilot pressure to the boom lowering pilot port at an opening degree corresponding to a magnitude of the boom lowering pilot pressure so as to make the boom cylinder operate in a direction to lower the boom, it is preferable that the boom flow rate operation part includes: a boom raising flow rate operation valve interposed between a pilot pressure source and the boom raising pilot port and operated to perform opening and closing motions by input of a boom raising flow rate command signal so as to make the boom raising pilot pressure to be input to the boom raising pilot port be a pilot pressure having a magnitude corresponding to the boom raising flow rate command signal; a boom lowering flow rate operation valve interposed between the pilot hydraulic pressure source and the boom lowering pilot port and operated to perform opening and closing motions by input of a boom lowering pilot pressure to the boom lowering pilot port so as to make the boom lowering pilot pressure be a pilot pressure having a magnitude corresponding to the boom lowering flow rate command; and a boom flow rate command part configured to input the boom raising flow rate command signal or the boom lowering flow rate command signal corresponding to a target supply flow rate to a flow rate operation valve that operates an opening on a supply side of a boom flow rate control valve out of the boom raising flow rate operation valve and boom lowering flow rate operation valve so as to make the boom cylinder supply rate be the target supply flow rate corresponding to the target boom cylinder speed when a direction of the target boom cylinder speed coincides with a direction of the cylinder thrust and configured to input the boom raising flow rate command signal or the boom lowering flow rate command signal corresponding to a target discharge flow rate to a flow rate operation valve that operates an opening on a discharge side of the boom flow rate control valve out of the boom raising flow rate operation valve and the boom lowering flow rate operation valve so as to make the boom cylinder discharge flow rate be the target discharge flow rate corresponding to the target boom cylinder speed when the direction of the target boom cylinder speed is opposite to the direction of the cylinder thrust.

Preferably, the hydraulic drive apparatus further includes a target pressing force setting part that sets a target pressing force which is a target value of a pressing force for pressing the bucket against the construction surface, a pressing force calculation part that calculates the pressing force based on the cylinder thrust, and a target boom cylinder speed correction part that corrects the target boom cylinder speed in a direction to make a deviation between the target pressing force and the calculated pressing force closer to 0 based on the deviation, and the boom flow rate operation part is configured to operate the boom flow rate control valve so as to provide the target boom cylinder speed that has been already corrected by the target speed correction part.

The correction of the target boom cylinder speed based on the pressing force by the target speed correction part, that is, the correction to make the deviation of the pressing force from the target pressing force be closer to 0, enables the driving of the boom cylinder to be performed for making the pressing force for pressing the bucket against the construction surface closer to the target pressing force, in addition to making the construction surface by the bucket closer to the target construction surface. Moreover, the above-described selection of the adjustment target flow rate (boom cylinder supply flow rate or boom cylinder discharge flow rate) based on whether or not the direction of the target boom cylinder speed and the direction of the cylinder thrust is coincident with each other increases the accuracy of the control of the operation speed of the boom cylinder regardless of the variation in the load acting on the boom depending on the magnitude of the pressing force, thereby increasing the accuracy of the control of the pressing force as a result.

Preferably, a boom driving hydraulic pump, which is a hydraulic pump connected to the at least one boom cylinder out of the at least one hydraulic pump included in the hydraulic oil supply device, is formed of a variable displacement hydraulic pump. This allows the boom drive hydraulic pump to discharge hydraulic oil at a proper flow rate corresponding to the required supply flow rate including the supply flow rate to the boom cylinder regardless of the operation state of the boom cylinder. Specifically, it is preferable that the hydraulic drive apparatus further includes a pump pressure detector that detects a pump pressure which is a pressure of hydraulic oil discharged from the boom drive hydraulic pump, a pump capacity control part that changes a pump capacity of the boom driving hydraulic pump, a pump speed detector that detects a pump speed which is a rotational speed of the boom drive hydraulic pump, and that the pump capacity control part is configured to change the pump capacity of the boom drive hydraulic pump based on the pump speed detected by the pump speed detector so as to make a flow rate of hydraulic oil discharged from the boom driving hydraulic pump be the flow rate corresponding to the sum of the target supply flow rate and a boom cylinder exclusion flow rate which is a flow rate of hydraulic oil to be supplied to an object other than the boom cylinder when the direction of the target boom cylinder speed and the direction of the cylinder thrust are coincident with each other, and configured to calculate a boom cylinder absorption flow rate which is a flow rate of hydraulic oil having passed through the supply-side opening and absorbed in the at least one boom cylinder based on the head pressure or the pump pressure detected by the boom cylinder pressure detector, the pump pressure detected by the pump pressure detector and an opening degree of the supply-side opening which is an opening for allowing the supply of the hydraulic oil from the boom drive hydraulic pump to the boom cylinder out of the openings formed in the boom flow rate control valve and to change the pump capacity of the boom drive hydraulic pump based on the pump rotational speed so as to make the flow rate of hydraulic oil discharged from the boom drive hydraulic pump be a flow rate corresponding to the sum of the boom cylinder absorption flow rate and the boom cylinder exclusion flow rate, when the direction of the target boom cylinder speed is opposite to the direction of the cylinder thrust.

This configuration makes it possible to perform proper pump capacity control for the boom driving pump not only when the flow rate of hydraulic oil supplied to the at least one boom cylinder is controlled, as usual, but also when the flow rate of hydraulic oil discharged from the boom cylinder is controlled (that is, when the direction of the target boom cylinder speed is opposite to the direction of the cylinder thrust). Specifically, even when the flow rate of the hydraulic oil discharged from the boom cylinder is controlled for the reason that the direction of the target boom cylinder speed is opposite to the direction of the cylinder thrust, a part of the hydraulic oil discharged from the boom drive hydraulic pump is absorbed in the boom cylinder through the supply-side opening of the boom flow rate control valve along with the operation of the boom cylinder; therefore, increasing the pump capacity of the boom drive hydraulic pump in anticipation of the flow rate of the absorbed hydraulic oil makes it possible to ensure sufficient flow rate of hydraulic oil supplied from the boom drive hydraulic pump to the object other than the boom cylinder. More specifically, calculating the boom cylinder absorption flow rate which is the flow rate of hydraulic oil passing through the supply-side opening based on the opening degree of the supply-side opening or the like and operating the pump capacity of the boom drive hydraulic pump so as to make the flow rate of hydraulic oil discharged from the boom drive hydraulic pump be a flow rate corresponding to the sum of the boom cylinder absorption flow rate and the boom cylinder exclusion flow rate makes it possible to secure the flow rate of hydraulic oil to be supplied to the other hydraulic actuator irrespective of the absorption of hydraulic oil in the boom cylinder.

The invention claimed is:

1. A hydraulic drive apparatus installed in a work machine equipped with a machine body and a work device attached to the machine body, the work device including a boom supported on the machine body so as to be raiseable and lowerable, an arm connected to a distal end of the boom so as to be rotationally movable, and a bucket attached to a distal end of the arm to be pressed against a construction surface, to hydraulically drive the boom, the arm, and the bucket, the hydraulic drive apparatus comprising:

a hydraulic oil supply device including at least one hydraulic pump that is driven by a driving source to thereby discharge hydraulic oil;

at least one boom cylinder that is expanded and contracted by supply of the hydraulic oil from the hydraulic oil supply device to thereby raise and lower the boom;

an arm cylinder that is expanded and contracted by supply of the hydraulic oil from the hydraulic oil supply device to thereby rotationally move the arm;

a bucket cylinder that is expanded and contracted by supply of the hydraulic oil from the hydraulic oil supply device to thereby rotationally move the bucket;

a boom flow rate control valve interposed between the hydraulic oil supply device and the at least one boom cylinder and configured to perform opening and closing motions to change a boom cylinder supply flow rate which is a flow rate of the hydraulic oil supplied from the hydraulic oil supply device to the at least one boom cylinder and a boom cylinder discharge flow rate which is a flow rate of the hydraulic oil discharged from the at least one boom cylinder;

a target construction surface setting part that sets a target construction surface defining a target shape of an object to be constructed by the bucket;

a working posture detection part that detects posture information which is information for determining a posture of the work device;

a boom cylinder pressure detector that detects a head pressure and a rod pressure which are respective pressures of a head-side chamber and a rod-side chamber of the at least one boom cylinder;

a cylinder speed calculation part that calculates cylinder speeds, which are respective operation speeds of the at least one boom cylinder, the arm cylinder and the bucket cylinder, based on the posture information detected by the working posture detection part;

a target boom cylinder speed calculation part that calculates a target boom cylinder speed which is a target value of an operation speed of the at least one boom cylinder for making a surface to be constructed by the bucket along with a movement of the arm caused by expansion and contraction of the arm cylinder closer to the target construction surface based on the cylinder speeds calculated by the cylinder speed calculation part; and a boom flow rate operation part that operates the boom flow rate control valve to provide the target boom cylinder speed, wherein the boom flow rate operation part is configured to operate the boom flow rate control valve to make the boom cylinder supply flow rate be a target supply flow rate corresponding to the target boom cylinder speed when a direction of the target boom cylinder speed calculated by the target boom cylinder speed calculation part coincides with a direction of a cylinder thrust which is a thrust of the at least one boom cylinder determined by the head pressure and the rod pressure detected by the boom cylinder pressure detector, and operate the boom flow rate control valve to make the boom cylinder discharge flow rate be a target discharge flow rate corresponding to the target boom cylinder speed when the direction of the target boom cylinder speed is opposite to the direction of the cylinder thrust.

2. The hydraulic drive apparatus according to claim 1, wherein the boom flow rate control valve is a pilot operated direction selector valve having a boom raising pilot port and a boom lowering pilot port, configured to be opened by an input of a boom raising pilot pressure to the boom raising pilot port at an opening degree corresponding to a magnitude of the boom raising pilot pressure so as to make the at least one boom cylinder operate in a direction to raise the boom, and be opened by an input of a boom lowering pilot pressure to the boom lowering pilot port at an opening degree corresponding to a magnitude of the boom lowering pilot pressure so as to make the at least one boom cylinder operate in a direction to lower the boom, and the boom flow rate operation part includes:

a boom raising flow rate operation valve interposed between a pilot pressure source and the boom raising pilot port and operated to perform opening and closing motions by an input of a boom raising flow rate command signal to the boom raising pilot port so as to make the boom raising pilot pressure be a pilot pressure having a magnitude corresponding to the boom raising flow rate command signal;

a boom lowering flow rate operation valve interposed between the pilot pressure source and the boom lowering pilot port and operated to perform opening and closing motions by an input of a boom lowering flow rate command signal to the boom lowering pilot port so as to make the boom lowering pilot pressure be a pilot pressure having a magnitude corresponding to the boom lowering flow rate command signal; and a boom flow rate command part configured to input the boom raising flow rate command signal or the boom lowering flow rate command signal corresponding to the target supply flow rate to a flow rate operation valve that operates an opening on a supply side of the boom flow rate control valve out of the boom raising flow rate operation valve and boom lowering flow rate operation valve so as to make a boom cylinder supply rate be the target supply flow rate corresponding to the target boom cylinder speed when a direction of the target boom cylinder speed coincides with the direction of the cylinder thrust, and input the boom raising flow rate command signal or the boom lowering flow rate command signal corresponding to the target discharge flow rate to the flow rate operation valve that operates an opening on a discharge side of the boom flow rate control valve out of the boom raising flow rate operation valve and the boom lowering flow rate operation valve so as to make the boom cylinder discharge flow rate be the target discharge flow rate corresponding to the target boom cylinder speed when the direction of the target boom cylinder speed is opposite to the direction of the cylinder thrust.

3. The hydraulic drive apparatus according to claim 1, further comprising:

a target pressing force setting part that sets a target pressing force which is a target value of a pressing force for pressing the bucket against the construction surface, a pressing force calculation part that calculates a pressing force based on the cylinder thrust, and a target boom cylinder speed correction part that corrects the target boom cylinder speed in a direction to make a deviation between the target pressing force and the calculated pressing force closer to 0 based on the deviation, wherein the boom flow rate operation part is configured to operate the boom flow rate control valve so as to provide the target boom cylinder speed that has been already corrected by the target boom cylinder speed correction part.

4. The hydraulic drive apparatus according to claim 1, wherein a boom driving hydraulic pump which is a hydraulic pump connected to the at least one boom cylinder out of the at least one hydraulic pump included in the hydraulic oil supply device is formed of a variable displacement hydraulic pump, the hydraulic drive apparatus further comprising:

a pump pressure detector that detects a pump pressure which is a pressure of hydraulic oil discharged from the boom driving hydraulic pump;

a pump capacity control part that changes a pump capacity of the boom driving hydraulic pump; and a pump speed detector that detects a pump speed which is a rotational speed of the boom driving hydraulic pump, wherein the pump capacity control part is configured to change a pump capacity of the boom driving hydraulic pump based on a pump speed detected by the pump speed detector so as to make a flow rate of hydraulic oil discharged from the boom driving hydraulic pump be a flow rate corresponding to a sum of the target supply flow rate and a boom cylinder exclusion flow rate which is a flow rate of hydraulic oil to be supplied to an object other than the at least one boom cylinder when the direction of the target boom cylinder speed and the direction of the cylinder thrust are coincident with each other, and the pump capacity control part is configured to calculate a boom cylinder absorption flow rate which is a flow rate of hydraulic oil having passed through a supply-side opening and absorbed in the at least one boom cylinder based on the head pressure or a pump pressure detected by the boom cylinder pressure detector, a pump pressure detected by the pump pressure detector and an opening degree of the supply-side opening which is an opening for allowing a supply of the hydraulic oil from the boom driving hydraulic pump to the at least one boom cylinder out of openings formed in the boom flow rate control valve and to change the pump capacity of the boom driving hydraulic pump based on a pump rotational speed so as to make the flow rate of the hydraulic oil discharged from the boom driving hydraulic pump be a flow rate corresponding to a sum of the boom cylinder absorption flow rate and the boom cylinder exclusion flow rate, when the direction of the target boom cylinder speed is opposite to the direction of the cylinder thrust.

* * * * *